US012297543B2

(12) United States Patent
Kawasaki et al.

(10) Patent No.: US 12,297,543 B2
(45) Date of Patent: May 13, 2025

(54) HIGH STRENGTH STEEL SHEET, IMPACT ABSORBING MEMBER, AND METHOD FOR MANUFACTURING HIGH STRENGTH STEEL SHEET

(71) Applicant: JFE Steel Corporation, Tokyo (JP)

(72) Inventors: Yoshiyasu Kawasaki, Tokyo (JP); Muneka Iwasawa, Tokyo (JP); Yuki Toji, Tokyo (JP); Yoshimasa Funakawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 326 days.

(21) Appl. No.: 17/766,412

(22) PCT Filed: Sep. 25, 2020

(86) PCT No.: PCT/JP2020/036363
§ 371 (c)(1),
(2) Date: Apr. 4, 2022

(87) PCT Pub. No.: WO2021/070640
PCT Pub. Date: Apr. 15, 2021

(65) Prior Publication Data

US 2024/0052464 A1 Feb. 15, 2024

(30) Foreign Application Priority Data

Oct. 11, 2019 (JP) ..... 2019-187297

(51) Int. Cl.

| | |
|---|---|
| ***C23C 2/02*** | (2006.01) |
| ***C21D 8/02*** | (2006.01) |
| ***C22C 38/00*** | (2006.01) |
| ***C22C 38/04*** | (2006.01) |
| ***C22C 38/06*** | (2006.01) |
| ***C23C 2/28*** | (2006.01) |

(52) U.S. Cl.
CPC ..... *C23C 2/024* (2022.08); *C21D 8/0205* (2013.01); *C21D 8/0236* (2013.01); *C21D 8/0273* (2013.01); *C21D 8/0278* (2013.01); *C22C 38/001* (2013.01); *C22C 38/04* (2013.01); *C22C 38/06* (2013.01); *C23C 2/02* (2013.01); *C23C 2/0224* (2022.08); *C23C 2/28* (2013.01); *C21D 2211/001* (2013.01); *C21D 2211/005* (2013.01); *C21D 2211/008* (2013.01)

(58) Field of Classification Search
CPC ..... C21D 2211/001; C21D 2211/005; C21D 2211/008; C21D 1/19; C23C 2/0224
See application file for complete search history.

(56) References Cited

U.S. PATENT DOCUMENTS

| | | | |
|---|---|---|---|
| 5,328,528 | A | 7/1994 | Chen |
| 6,544,354 | B1 | 4/2003 | Kawano et al. |
| 2015/0000802 | A1 | 1/2015 | Naitou et al. |
| 2019/0106760 | A1 | 4/2019 | Yamashita et al. |
| 2019/0271051 | A1 | 9/2019 | Kawasaki et al. |
| 2019/0284656 | A1* | 9/2019 | Kawasaki ..... C22C 38/08 |
| 2021/0115541 | A1 | 4/2021 | Endo et al. |

FOREIGN PATENT DOCUMENTS

| | | | |
|---|---|---|---|
| CN | 1241219 | A | 1/2000 |
| CN | 1246161 | A | 3/2000 |
| CN | 101264681 | A | 9/2008 |
| CN | 104204252 | A | 12/2014 |
| CN | 105492643 | A | 4/2016 |
| CN | 105940134 | A | 9/2016 |
| CN | 108350546 | A | 7/2018 |
| CN | 111684084 | A | 9/2020 |
| EP | 0952235 | A1 | 10/1999 |
| EP | 3009527 | A1 | 4/2016 |
| EP | 3101147 | A1 | 12/2016 |
| EP | 3372703 | A1 | 9/2018 |
| EP | 3660177 | A1 | 6/2020 |
| EP | 3757242 | A1 | 12/2020 |
| EP | 3778974 | A1 | 2/2021 |
| EP | 3778975 | A1 | 2/2021 |
| JP | 61157625 | A | 7/1986 |
| JP | 01259120 | A | 10/1989 |
| JP | 11189839 | A | 7/1999 |

(Continued)

OTHER PUBLICATIONS

International Search Report and Written Opinion for International Application No. PCT/JP2020/036363, dated Dec. 1, 2020, 5 pages.
Chinese Office Action with Search Report for Chinese Application No. 202080070419.8, dated Nov. 28, 2022, 11 pages.
European Communication pursuant to Article 94(3) for European Application No. 20874097.7, dated Oct. 12, 2023, 6 pages.
Extended European Search Report for European Application No. 20874097.7, dated Feb. 20, 2023, 11 pages.
Dey, Indrajit et al., "Effects of Cooling Rate and Strain Rate on Phase Transformation, Microstructure and Mechanical Behaviour of Thermomechanically Processed Pearlitic Steel", Journal of Materials Research and Technology, vol. 8(3), May 1, 2019, pp. 2685-2698, XP093022527.

(Continued)

*Primary Examiner* — Anthony M Liang
*Assistant Examiner* — Jacob J Gusewelle
(74) *Attorney, Agent, or Firm* — Buchanan Ingersoll & Rooney PC

(57) ABSTRACT

A high strength steel sheet has a yield-point elongation of 1.0% or greater and a tensile strength of 980 MPa or greater. The high strength steel sheet has a specific chemical composition and microstructure. The ferrite has an average grain size of 5.0 μm or less, the retained austenite has an average grain size of 2.0 μm or less, a value obtained by dividing a Mn content of the retained austenite by a Mn content of steel is 1.50 or greater, 15% or more of all retained austenite grains in the retained austenite have an aspect ratio of 3.0 or greater, and 15% or more of all the retained austenite grains in the retained austenite have an aspect ratio of less than 2.0.

16 Claims, No Drawings

(56) References Cited

FOREIGN PATENT DOCUMENTS

| | | | |
|---|---|---|---|
| JP | 2003138345 | A | 5/2003 |
| JP | 2003193193 | A | 7/2003 |
| JP | 2005290477 | A | 10/2005 |
| JP | 2007162078 | A | 6/2007 |
| JP | 2015078394 | A | 4/2015 |
| JP | 2017053001 | A | 3/2017 |
| JP | 2019014933 | A | 1/2019 |
| JP | 6587038 | B1 | 10/2019 |
| WO | 2017183349 | A1 | 10/2017 |
| WO | 2018092817 | A1 | 5/2018 |
| WO | 2019154819 | A1 | 8/2019 |
| WO | 2019159771 | A1 | 8/2019 |
| WO | 2019188640 | A1 | 10/2019 |
| WO | 2019188642 | A1 | 10/2019 |
| WO | 2019188643 | A1 | 10/2019 |
| WO | 2019194250 | A1 | 10/2019 |

OTHER PUBLICATIONS

Korean Office Action for Korean Application No. 10-2022-7011342, dated Mar. 15, 2024 with Concise Statement of Relevance of Office Action. (11 pages).

* cited by examiner

HIGH STRENGTH STEEL SHEET, IMPACT ABSORBING MEMBER, AND METHOD FOR MANUFACTURING HIGH STRENGTH STEEL SHEET

CROSS REFERENCE TO RELATED APPLICATIONS

This is the U.S. National Phase application of PCT/JP2020/036363, filed Sep. 25, 2020, which claims priority to Japanese Patent Application No. 2019-187297, filed Oct. 11, 2019, the disclosures of these applications being incorporated herein by reference in their entireties for all purposes.

FIELD OF THE INVENTION

The present invention relates to a high strength steel sheet suitable for use in impact energy absorbing members that are used in the motor vehicle field, and also relates to a crash energy absorbing member. In particular, the present invention relates to a high strength steel sheet and a crash energy absorbing member that have a yield-point elongation (YP-EL) of 1.0% or greater and a tensile strength (TS) of 980 MPa or greater and also have excellent uniform ductility, bendability, and crush performance, and the present invention also relates to a method for manufacturing the high strength steel sheet.

BACKGROUND OF THE INVENTION

In recent years, improving fuel efficiency of motor vehicles has been an important issue in terms of protecting the global environment. Correspondingly, efforts are being actively made to reduce the weight of the vehicle body itself by increasing the strength of a material for the vehicle body, thereby reducing the thickness of the material for the vehicle body. In addition, social demand for improvement in the crash safety of motor vehicles is further increasing, and there is a need not only for an increase in the strength of a steel sheet but also for the development of a steel sheet having excellent crashworthiness (crush performance) that can be exhibited in the event of a crash during vehicle running and the development of members thereof.

However, steel sheets that have been used in impact energy absorbing members, which are typified by front side members and rear side members, have a tensile strength (TS) of less than only 850 MPa. A reason for this is that steel sheets having increased strength have reduced formability, for example, reduced local ductility, bendability, and the like and, therefore, become cracked in a bending crush test or an axial crush test that simulates a crash test, which indicates an inability to absorb impact energy sufficiently.

A proposed steel sheet having high strength and high ductility is a high strength steel sheet that utilizes strain-induced transformation of retained austenite. The high strength steel sheet exhibits a microstructure including retained austenite. During forming, the retained austenite facilitates forming, and after forming, the retained austenite is transformed into martensite; as a result, high strength is achieved. For example, Patent Literature 1 describes a high strength steel sheet having a tensile strength of 1,000 MPa or greater and a total elongation (EL) of 30% or greater. The high strength steel sheet utilizes strain-induced transformation of retained austenite and has very high ductility. Furthermore, Patent Literature 2 describes an invention that realizes a high strength-ductility balance, which is achieved by using a high Mn steel and performing a heat treatment in a ferrite-austenite two-phase temperature region. Furthermore, Patent Literature 3 describes an invention that improves local ductility, which is achieved by using a high Mn steel to obtain a hot-rolled microstructure including bainite and martensite; and performing annealing and tempering to form fine retained austenite and obtain a microstructure including tempered bainite or tempered martensite. In addition, Patent Literature 4 describes a high strength steel sheet, a high strength hot-dip galvanized steel sheet, and a high strength hot-dip galvannealed steel sheet that have a maximum tensile strength (TS) of 780 MPa or greater and can be used in impact absorbing members for crash events.

PATENT LITERATURE

PTL 1: Japanese Unexamined Patent Application Publication No. 61-157625
PTL 2: Japanese Unexamined Patent Application Publication No. 1-259120
PTL 3: Japanese Unexamined Patent Application Publication No. 2003-138345
PTL 4: Japanese Unexamined Patent Application Publication No. 2015-78394

SUMMARY OF THE INVENTION

The high strength steel sheet described in Patent Literature 1 is manufactured by performing a so-called austemper process, in which a steel sheet including C, Si, and Mn as basic components is austenized, and subsequently, the resulting steel sheet is quenched to a temperature within a bainite transformation temperature region and held at an isothermal temperature. The austemper process causes the austenite to be enriched with C, and, accordingly, retained austenite is formed. To obtain a large amount of retained austenite, adding a large amount of C is necessary, that is, a C content of greater than 0.3% is necessary. However, when the amount of C in steel is high, spot weldability is reduced, and the reduction is significant when an amount of C, in terms of a content, is greater than 0.3%. Accordingly, it is difficult to practically use the high strength steel sheet described in Patent Literature 1 as an automotive steel sheet. Furthermore, in the invention described in Patent Literature 1, a principal object is to improve the ductility of a high strength steel sheet, and, therefore, bendability and crush performance are not considered. Furthermore, in the invention described in Patent Literature 2, improving ductility, particularly, uniform ductility, by enriching untransformed austenite with Mn is not discussed, and, therefore, there is room for improvement in formability. Furthermore, in the steel sheet described in Patent Literature 3, a microstructure includes a large amount of bainite or martensite that has been tempered at a high temperature, and, therefore, ensuring strength is difficult; in addition, an amount of retained austenite is limited to improve local ductility, and, consequently, a total elongation is insufficient. Furthermore, in the high strength steel sheet, the high strength hot-dip galvanized steel sheet, and the high strength hot-dip galvannealed steel sheet described in Patent Literature 4, an amount of retained austenite is approximately 2%, and, therefore, ductility, particularly, uniform ductility, is low and insufficient.

Aspects of the present invention have been made in view of the problems described above, and objects according to aspects of the present invention are to provide a high strength steel sheet and a crash energy absorbing member that have a yield-point elongation (YP-EL) of 1.0% or greater and a tensile strength (TS) of 980 MPa or greater and also have excellent uniform ductility, bendability, and crush performance and to provide a method for manufacturing the high strength steel sheet.

To obtain a high strength steel sheet and a crash energy absorbing member that have a yield-point elongation (YP-EL) of 1.0% or greater and a tensile strength (TS) of 980 MPa or greater and also have excellent uniform ductility, bendability, and crush performance, the present inventors diligently performed studies from the standpoint of a chemical composition of a steel sheet and controlling of a microstructure thereof and, consequently, made the following discoveries.

Specifically, it was found that a high strength steel sheet and a crash energy absorbing member that have a yield-point elongation (YP-EL) of 1.0% or greater and a tensile strength (TS) of 980 MPa or greater and also have excellent uniform ductility, bendability, and crush performance can be obtained as follows. A chemical composition is to be a specific chemical composition, in which, in particular, a content of Mn is controlled to be 3.10 mass % or greater and 6.00 mass % or less. A microstructure is to be controlled to be a microstructure in which ferrite is present in an area fraction of 30.0% or greater and less than 80.0%, martensite is present in an area fraction of 3.0% or greater and 30.0% or less, retained austenite is present in a volume fraction of 12.0% or greater, the ferrite has an average grain size of 5.0 μm or less, the retained austenite has an average grain size of 2.0 μm or less, a value obtained by dividing a Mn content (mass %) of the retained austenite by a Mn content (mass %) of the steel is 1.50 or greater, 15% or more of all the retained austenite grains in the retained austenite have an aspect ratio of 3.0 or greater, and 15% or more of all the retained austenite grains in the retained austenite have an aspect ratio of less than 2.0, wherein a value obtained by dividing a volume fraction Vγa by a volume fraction Vγb is 0.40 or greater, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C.

Aspects of the present invention were made based on the above-described discoveries, and a summary of aspects of the present invention is as follows.

[1] A high strength steel sheet, the high strength steel sheet having a yield-point elongation (YP-EL) of 1.0% or greater and a tensile strength (TS) of 980 MPa or greater, the high strength steel sheet having a chemical composition containing, in mass %, C: 0.030% or greater and 0.250% or less, Si: 2.00% or less, Mn: 3.10% or greater and 6.00% or less, P: 0.100% or less, S: 0.0200% or less, N: 0.0100% or less, and Al: 1.200% or less, with the balance being Fe and incidental impurities, and the high strength steel sheet having a microstructure in which ferrite is present in an area fraction of 30.0% or greater and less than 80.0%, martensite is present in an area fraction of 3.0% or greater and 30.0% or less, retained austenite is present in a volume fraction of 12.0% or greater, the ferrite has an average grain size of 5.0 μm or less, the retained austenite has an average grain size of 2.0 μm or less, a value obtained by dividing a Mn content (mass %) of the retained austenite by a Mn content (mass %) of steel is 1.50 or greater, 15% or more of all retained austenite grains in the retained austenite have an aspect ratio of 3.0 or greater, and 15% or more of all the retained austenite grains in the retained austenite have an aspect ratio of less than 2.0, wherein a value obtained by dividing a volume fraction Vγa by a volume fraction Vγb is 0.40 or greater, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C.

[2] The high strength steel sheet according to [1], the high strength steel sheet having a yield-point elongation (YP-EL) of 1.0% or greater and a tensile strength (TS) of 980 MPa or greater, the high strength steel sheet having a chemical composition containing, in mass %, C: 0.030% or greater and 0.250% or less, Si: 0.01% or greater and 2.00% or less, Mn: 3.10% or greater and 6.00% or less, P: 0.001% or greater and 0.100% or less, S: 0.0001% or greater and 0.0200% or less, N: 0.0005% or greater and 0.0100% or less, and Al: 0.001% or greater and 1.200% or less, with the balance being Fe and incidental impurities, and the high strength steel sheet having the microstructure in which ferrite is present in an area fraction of 30.0% or greater and less than 80.0%, martensite is present in an area fraction of 3.0% or greater and 30.0% or less, retained austenite is present in a volume fraction of 12.0% or greater, the ferrite has an average grain size of 5.0 μm or less, the retained austenite has an average grain size of 2.0 μm or less, a value obtained by dividing a Mn content (mass %) of the retained austenite by a Mn content (mass %) of steel is 1.50 or greater, 15% or more of all retained austenite grains in the retained austenite have an aspect ratio of 3.0 or greater, and 15% or more of all the retained austenite grains in the retained austenite have an aspect ratio of less than 2.0, wherein a value obtained by dividing a volume fraction Vγa by a volume fraction Vγb is 0.40 or greater, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C.

[3] The high strength steel sheet according to [1] or [2], the high strength steel sheet having a yield-point elongation (YP-EL) of 1.0% or greater and a tensile strength (TS) of 980 MPa or greater, wherein the chemical composition further contains, in mass %, at least one element selected from Ti: 0.200% or less, Nb: 0.200% or less, V: 0.500% or less, W: 0.500% or less, B: 0.0050% or less, Ni: 1.000% or less, Cr: 1.000% or less, Mo: 1.000% or less, Cu: 1.000% or less, Sn: 0.200% or less, Sb: 0.200% or less, Ta: 0.100% or less, Zr: 0.0050% or less, Ca: 0.0050% or less,
Mg: 0.0050% or less, and
REM: 0.0050% or less.

[4] The high strength steel sheet according to [3], the high strength steel sheet having a yield-point elongation (YP-EL) of 1.0% or greater and a tensile strength (TS) of 980 MPa or greater, wherein the chemical composition contains, in mass %, at least one element selected from Ti: 0.002% or greater and 0.200% or less,
Nb: 0.005% or greater and 0.200% or less,
V: 0.005% or greater and 0.500% or less,
W: 0.0005% or greater and 0.500% or less,
B: 0.0003% or greater and 0.0050% or less,
Ni: 0.005% or greater and 1.000% or less,
Cr: 0.005% or greater and 1.000% or less,
Mo: 0.005% or greater and 1.000% or less,
Cu: 0.005% or greater and 1.000% or less,
Sn: 0.002% or greater and 0.200% or less,
Sb: 0.002% or greater and 0.200% or less,
Ta: 0.001% or greater and 0.100% or less,
Zr: 0.0005% or greater and 0.0050% or less,
Ca: 0.0005% or greater and 0.0050% or less,
Mg: 0.0005% or greater and 0.0050% or less, and
REM: 0.0005% or greater and 0.0050% or less.

[5] The high strength steel sheet according to any one of [1] to [4], the high strength steel sheet having a yield-point elongation (YP-EL) of 1.0% or greater and a tensile strength (TS) of 980 MPa or greater, wherein an amount of diffusible hydrogen in steel is 0.50 mass-ppm or less.

[6] The high strength steel sheet according to any one of [1] to [5], the high strength steel sheet having a yield-point elongation (YP-EL) of 1.0% or greater and a tensile strength (TS) of 980 MPa or greater, wherein the high strength steel sheet has a zinc coated layer on a surface of the steel sheet.

[7] The high strength steel sheet according to any one of [1] to [5], the high strength steel sheet having a yield-point elongation (YP-EL) of 1.0% or greater and a tensile strength (TS) of 980 MPa or greater, wherein the high strength steel sheet has an aluminum coated layer on a surface of the steel sheet.

[8] An impact absorbing member, the impact absorbing member including an impact absorbing portion that absorbs impact energy by undergoing bending crush and deformation, the impact absorbing portion including the high strength steel sheet according to any one of [1] to [7].

[9] An impact absorbing member, the impact absorbing member including an impact absorbing portion that absorbs impact energy by undergoing axial crush and deformation into a bellows shape, the impact absorbing portion including the high strength steel sheet according to any one of [1] to [7].

[10] A method for manufacturing the high strength steel sheet according to any one of [1] to [4], the method including performing a pickling process on a hot rolled steel sheet; holding a resulting steel sheet within a temperature range of an $Ac_1$ transformation temperature or greater and "the $Ac_1$ transformation temperature+150° C." or less for a period of more than 21,600 seconds and 259,200 seconds or less; subsequently cooling the resulting steel sheet at an average cooling rate of 5° C./hour or greater and 200° C./hour or less through a temperature range of 550° C. to 400° C.; subsequently cold rolling the resulting steel sheet; heating a resulting cold rolled steel sheet at an average heating rate of 8° C./second or greater and 50° C./second or less through a temperature range of 400° C. to the $Ac_1$ transformation temperature; and holding the resulting cold rolled steel sheet within a temperature range of the $Ac_1$ transformation temperature or greater and "the $Ac_1$ transformation temperature+150° C." or less for a period of 20 seconds or more and 3,600 seconds or less.

[11] A method for manufacturing the high strength steel sheet according to [6], the method including performing a pickling process on a hot rolled steel sheet; holding a resulting steel sheet within a temperature range of an $Ac_1$ transformation temperature or greater and "the $Ac_1$ transformation temperature+150° C." or less for a period of more than 21,600 seconds and 259,200 seconds or less; subsequently cooling the resulting steel sheet at an average cooling rate of 5° C./hour or greater and 200° C./hour or less through a temperature range of 550° C. to 400° C.; subsequently cold rolling the resulting steel sheet; heating a resulting cold rolled steel sheet at an average heating rate of 8° C./second or greater and 50° C./second or less through a temperature range of 400° C. to the $Ac_1$ transformation temperature; holding the resulting cold rolled steel sheet within a temperature range of the $Ac_1$ transformation temperature or greater and "the $Ac_1$ transformation temperature+150° C." or less for a period of 20 seconds or more and 3,600 seconds or less; and subsequently performing a hot-dip galvanizing process or an electrogalvanizing process on the resulting cold rolled steel sheet.

[12] A method for manufacturing the high strength steel sheet according to [7], the method including performing a pickling process on a hot rolled steel sheet; holding a resulting steel sheet within a temperature range of an $Ac_1$ transformation temperature or greater and "the $Ac_1$ transformation temperature+150° C." or less for a period of more than 21,600 seconds and 259,200 seconds or less; subsequently cooling the resulting steel sheet at an average cooling rate of 5° C./hour or greater and 200° C./hour or less through a temperature range of 550° C. to 400° C.; subsequently cold rolling the resulting steel sheet; heating a resulting cold rolled steel sheet at an average heating rate of 8° C./second or greater and 50° C./second or less through a temperature range of 400° C. to the $Ac_1$ transformation temperature; holding the resulting cold rolled steel sheet within a temperature range of the $Ac_1$ transformation temperature or greater and "the $Ac_1$ transformation temperature+150° C." or less for a period of 20 seconds or more and 3,600 seconds or less; and subsequently performing a hot-dip aluminum coating process on the resulting cold rolled steel sheet.

[13] The method for manufacturing the high strength steel sheet according to [10], wherein, after the resulting cold rolled steel sheet is held within the temperature range of the $Ac_1$ transformation temperature or greater and "the $Ac_1$ transformation temperature+150° C." or less for a period of 20 seconds or more and 3,600 seconds or less, the resulting cold rolled steel sheet is held within a temperature range of 50° C. or greater and 300° C. or less for a period of 1,800 seconds or more and 259,200 seconds or less.

[14] The method for manufacturing the high strength steel sheet according to [11] or [12], wherein, after the coating process, the resulting cold rolled steel sheet is held within a temperature range of 50° C. or greater and 300° C. or less for a period of 1,800 seconds or more and 259,200 seconds or less.

According to aspects of the present invention, it is possible to obtain a high strength steel sheet and a crash energy absorbing member that have a yield-point elongation (YP-EL) of 1.0% or greater and a tensile strength (TS) of 980

MPa or greater and also have excellent uniform ductility, bendability, and crush performance.

DETAILED DESCRIPTION OF EMBODIMENTS OF THE INVENTION

Now, a high strength steel sheet and a crash energy absorbing member according to aspects of the present invention will be described.

First, reasons for the limitations imposed on a chemical composition of the steel of the high strength steel sheet according to aspects of the present invention will be described.

C: 0.030% or Greater and 0.250% or Less

C is an element necessary for forming a low temperature transformed phase, such as martensite, thereby increasing the tensile strength of the steel sheet. Furthermore, C is an element effective for improving the stability of retained austenite, thereby improving the ductility, particularly, uniform ductility, of the steel sheet. If a C content is less than 0.030%, ensuring a desired area fraction of martensite is difficult, and, consequently, the desired tensile strength cannot be achieved. In addition, ensuring a sufficient volume fraction of retained austenite is difficult, and, consequently, good ductility, particularly, good uniform ductility, cannot be achieved. On the other hand, if an excessive amount of C is present, that is, if the content is greater than 0.250%, the area fraction of martensite, which is hard, becomes excessively high; consequently, the ductility, particularly, uniform ductility, of the steel sheet is reduced, and in addition, during various types of bending deformation, an increased number of microvoids are formed at grain boundaries of martensite. In addition, crack propagation progresses, that is, the bendability of the steel sheet is reduced. Furthermore, a weld zone and a heat-affected zone are significantly hardened, which reduces the mechanical properties of the weld zone, and, therefore, spot weldability, arc weldability, and the like are degraded. From these standpoints, the C content is specified to be 0.030% or greater and 0.250% or less. Preferably, the C content is 0.080% or greater and 0.200% or less.

Si: 2.00% or Less

Si is an element necessary for increasing the tensile strength of the steel sheet through solid solution strengthening of ferrite. Furthermore, Si improves the work hardenability of ferrite and is, therefore, effective for ensuring good ductility, particularly, good uniform ductility. If a Si content is less than 0.01%, the effect is not sufficiently produced. Accordingly, it is preferable that the lower limit of the Si content be 0.01%. On the other hand, if an excessive amount of Si is present, that is, if the content is greater than 2.00%, degradation in surface quality is caused, and in addition, a value obtained by dividing a volume fraction Vγa by a volume fraction Vγb cannot be a desired value, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C.; that is, good bendability and crush performance cannot be achieved. Accordingly, the Si content is specified to be less than or equal to 2.00%. The Si content is preferably greater than or equal to 0.01% and more preferably greater than or equal to 0.10%. Preferably, the Si content is less than or equal to 1.60%.

Mn: 3.10% or Greater and 6.00% or Less

In accordance with aspects of the present invention, Mn is a very important additive element. Mn is an element that stabilizes retained austenite and is, therefore, effective for ensuring good ductility, particularly, good uniform ductility. In addition, Mn is an element that increases the tensile strength of the steel sheet through solid solution strengthening. These functions are exhibited when a Mn content is 3.10% or greater. On the other hand, if an excessive amount of Mn is present, that is, if the content is greater than 6.00%, degradation in surface quality is caused, and in addition, the value obtained by dividing a volume fraction Vγa by a volume fraction Vγb cannot be a desired value, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C.; that is, good bendability and crush performance cannot be achieved. From these standpoints, the Mn content is specified to be 3.10% or greater and 6.00% or less. Preferably, the Mn content is 3.40% or greater and 5.20% or less.

P: 0.100% or Less

P is an element that has a function of achieving solid solution strengthening and can be included corresponding to a desired tensile strength. Furthermore, P is also an element effective for forming a multi-phase structure because P promotes ferrite transformation. It is preferable that a P content be greater than or equal to 0.001% so as to produce these effects. On the other hand, if the P content is greater than 0.100%, weldability is degraded, and in an instance where a hot-dip zinc coating is subjected to an alloying process, an alloying speed is reduced, which diminishes the quality of the hot-dip zinc coating. Accordingly, the P content is specified to be less than or equal to 0.100%. The P content is preferably greater than or equal to 0.001% and more preferably greater than or equal to 0.005%. Preferably, the P content is less than or equal to 0.050%.

S: 0.0200% or Less

S embrittles the steel sheet during hot working by segregating at grain boundaries and, in addition, reduces the bendability of the steel sheet by existing as a sulfide. Accordingly, a S content needs to be less than or equal to 0.0200%. Preferably, the S content is less than or equal to 0.0100%, and more preferably, less than or equal to 0.0050%. Since there are constraints associated with industrial technologies, it is preferable that the S content be greater than or equal to 0.0001%.

N: 0.0100% or Less

N is an element that degrades the aging resistance of the steel sheet. In particular, if a N content is greater than 0.0100%, the aging resistance is significantly degraded. It is preferable that the N content be as low as possible; however, since there are constraints associated with industrial technologies, it is preferable that the N content be greater than or equal to 0.0005%. Accordingly, the N content is specified to be less than or equal to 0.0100%. Preferably, the N content is greater than or equal to 0.0005%, and more preferably, greater than or equal to 0.0010%. Preferably, the N content is less than or equal to 0.0070%.

Al: 1.200% or Less

Al expands the ferrite-austenite two-phase temperature region, thereby reducing the annealing temperature dependence of mechanical properties. That is, Al is an element effective for achieving stability of mechanical properties. If an Al content is less than 0.001%, an effect of the addition of Al is not sufficiently produced. Accordingly, it is preferable that the lower limit be specified to be 0.001%. Furthermore, Al is an element that acts as a deoxidizing agent and is, therefore, effective for achieving cleanliness of the steel sheet. It is preferable that in a deoxidizing process, Al be included. However, if a large amount of Al is present, that is, if the Al content is greater than 1.200%, the risk of the occurrence of strand cracking during continuous casting increases, which reduces manufacturability. From these standpoints, the Al content is specified to be less than or equal to 1.200%. The Al content is preferably greater than or equal to 0.001%, more preferably greater than or equal to 0.020%, and even more preferably greater than or equal to 0.030%. The Al content is preferably less than or equal to 1.000% and more preferably less than or equal to 0.800%.

In addition to the components described above, at least one element selected from the following elements may be further included: in mass %, Ti: 0.200% or less, Nb: 0.200% or less, V: 0.500% or less, W: 0.500% or less, B: 0.0050% or less, Ni: 1.000% or less, Cr: 1.000% or less, Mo: 1.000% or less, Cu: 1.000% or less, Sn: 0.200% or less, Sb: 0.200% or less, Ta: 0.100% or less, Zr: 0.0050% or less, Ca: 0.0050% or less, Mg: 0.0050% or less, and one or more REM: 0.0050% or less.

Ti: 0.200% or Less

Ti is effective for precipitation strengthening of the steel sheet. Ti improves the strength of ferrite, thereby reducing a difference in hardness between the ferrite and a hard second phase (martensite or retained austenite), and, therefore, Ti can ensure good bendability. Furthermore, Ti refines the grains of martensite and retained austenite, which results in good bendability. It is preferable that a Ti content be greater than or equal to 0.002% so as to produce the effect. However, if the content is greater than 0.200%, the area fraction of martensite, which is hard, becomes excessively high; consequently, during various types of bending tests, an increased number of microvoids are formed at grain boundaries of martensite, and crack propagation progresses, that is, the bendability of the steel sheet is reduced. Accordingly, in instances where Ti is to be included, the Ti content is specified to be less than or equal to 0.200%. The Ti content is preferably greater than or equal to 0.002% and more preferably greater than or equal to 0.005%. The Ti content is preferably less than or equal to 0.100%.

Nb: 0.200% or Less, V: 0.500% or Less, and W: 0.500% or Less

Nb, V, and W are effective for precipitation strengthening of steel. Furthermore, Nb, V, and W improve the strength of ferrite, thereby reducing a difference in hardness between the ferrite and a hard second phase (martensite or retained austenite), and, therefore, Nb, V, and W can ensure good bendability. Furthermore, Nb, V, and W refine the grains of martensite and retained austenite, which results in good bendability. It is preferable that a Nb content, a W content, and a V content each be greater than or equal to 0.005% so as to produce the effects. However, when the Nb content is greater than 0.200%, the V content is greater than 0.500%, and/or the W content is greater than 0.500%, the area fraction of martensite, which is hard, becomes excessively high; consequently, during a bendability test, an increased number of microvoids are formed at grain boundaries of martensite, and crack propagation progresses, that is, the bendability of the steel sheet is reduced. Accordingly, in instances where Nb is to be included, the Nb content is specified to be less than or equal to 0.200%. The Nb content is preferably greater than or equal to 0.005% and more preferably greater than or equal to 0.010%. The Nb content is preferably less than or equal to 0.100%. Furthermore, in instances where V and/or W are to be included, the V content and the W content are each specified to be less than or equal to 0.500%. The V content and the W content are each preferably greater than or equal to 0.005% and more preferably greater than or equal to 0.010%. The V content and the W content are each preferably less than or equal to 0.100%.

B: 0.0050% or Less

B inhibits the formation and growth of ferrite originating from the austenite grain boundaries. Accordingly, B produces an effect of refining the grains of phases, thereby improving the bendability of the steel sheet. It is preferable that a B content be greater than or equal to 0.0003% so as to produce the effect. However, if the B content is greater than 0.0050%, the ductility of the steel sheet is reduced. Accordingly, in instances where B is to be included, the B content is specified to be less than or equal to 0.0050%. The B content is preferably greater than or equal to 0.0003% and more preferably greater than or equal to 0.0005%. The B content is preferably less than or equal to 0.0030%.

Ni: 1.000% or Less

Ni is an element that stabilizes retained austenite and is, therefore, effective for ensuring good ductility, particularly, good uniform ductility. In addition, Ni is an element that increases the strength of the steel sheet through solid solution strengthening. It is preferable that a Ni content be greater than or equal to 0.005% so as to produce the effect. On the other hand, if the content is greater than 1.000%, the area fraction of martensite, which is hard, becomes excessively high; consequently, during a bendability test, an increased number of microvoids are formed at grain boundaries of martensite, and crack propagation progresses, that is, the bendability of the steel sheet is reduced. Accordingly, in instances where Ni is to be included, the Ni content is specified to be less than or equal to 1.000%.

Cr: 1.000% or Less and Mo: 1.000% or Less

Cr and Mo have a function of improving a balance between strength and ductility in the steel sheet. Accordingly, Cr and Mo may be included as necessary. It is preferable that a Cr content and a Mo content each be greater than or equal to 0.005% so as to produce the effect. However, if an excessive amount of Cr and/or Mo are present, that is, the Cr content and/or the Mo content are greater than 1.000%, the area fraction of martensite, which is hard, becomes excessively high; consequently, during a bendability test, an increased number of microvoids are formed at grain boundaries of martensite, and crack propagation progresses, that is, the bendability of the steel sheet is reduced. Accordingly, in instances where these elements are to be included, the contents are each specified to be less than or equal to 1.000%.

Cu: 1.000% or Less

Cu is an element effective for strengthening the steel sheet and may be included as necessary. It is preferable that a Cu content be greater than or equal to 0.005% so as to produce the effect. On the other hand, if the Cu content is greater than 1.000%, the area fraction of martensite, which is hard, becomes excessively high; consequently, during a bendability test, an increased number of microvoids are formed at grain boundaries of martensite, and in addition, crack propagation progresses; that is, the bendability of the steel sheet is reduced. Accordingly, in instances where Cu is to be included, the Cu content is specified to be less than or equal to 1.000%.

Sn: 0.200% or Less and Sb: 0.200% or Less

Sn and Sb may be included as necessary to inhibit decarburization that may occur when a surface of the steel sheet is nitrided and/or oxidized, in a region of approximately several tens of micrometers in a surface layer of the steel sheet. Inhibition of nitridation and oxidation results in inhibition of a reduction in the area fraction of martensite on a surface of the steel sheet. Accordingly, Sn and Sb are effective for ensuring the strength and stability of mechanical properties of the steel sheet. It is preferable that a Sn content and an Sb content each be greater than or equal to 0.002% so as to produce the effect. On the other hand, regarding each of these elements, if an excessive amount of the element is added, that is, the content is greater than 0.200%, the toughness of the steel sheet is reduced. Accordingly, in instances where these elements are to be included, the content of each of the elements is specified to be less than or equal to 0.200%.

Ta: 0.100% or Less

Similar to Ti and Nb, Ta contributes to increasing the strength of steel by forming an alloy carbide and/or an alloy carbonitride. In addition, Ta is partially dissolved in a Nb carbide and/or a Nb carbonitride to form a complex precipitate, such as (Nb, Ta) (C, N), thereby significantly inhibiting the coarsening of precipitates, which is believed to produce an effect of stabilizing the contribution to the strength of the steel sheet due to precipitation strengthening. It is preferable that a Ta content be greater than or equal to 0.001% so as to produce the above-described effect of stabilizing precipitates. On the other hand, even if an excessive amount of Ta is included, the effect of stabilizing precipitates no longer increases while alloying cost increases. Accordingly, in instances where Ta is to be included, the Ta content is specified to be less than or equal to 0.100%.

Zr: 0.0050% or Less, Ca: 0.0050% or Less, Mg: 0.0050% or Less, and REM: 0.0050% or Less Zr, Ca, Mg, and REMs are elements effective for spheroidizing the shape of sulfides to mitigate adverse effects of sulfides with respect to the bendability of the steel sheet. It is preferable that a content of each of these elements be greater than or equal to 0.0005% so as to produce the effect. However, if the content of any of these elements is excessively high, that is, if the content is greater than 0.0050%, an increased number of inclusions and the like are formed, and, consequently, surface and internal defects and the like occur. Accordingly, in instances where Zr, Ca, Mg, and one or more REM are to be included, the contents are each specified to be less than or equal to 0.0050%.

Note that the balance is Fe and incidental impurities.

Now, a microstructure of the high strength steel sheet according to aspects of the present invention will be described.

Area Fraction of Ferrite: 30.0% or Greater and Less than 80.0%

Ferrite needs to be present in an area fraction of greater than or equal to 30.0% so as to ensure good ductility, particularly, good uniform ductility, and ensure good bendability. Furthermore, the ferrite, which is soft, needs to be present in an area fraction of less than 80.0% so as to ensure the tensile strength of 980 MPa or greater. The area fraction of ferrite is preferably 35.0% or greater and 75.0% or less.

Area Fraction of Martensite: 3.0% or Greater and 30.0% or Less

Martensite, which is hard, needs to be present in an area fraction of greater than or equal to 3.0% so as to ensure the tensile strength of 980 MPa or greater. Furthermore, the martensite, which is hard, needs to be present in an area fraction of less than or equal to 30.0% so as to ensure good ductility, particularly, good uniform ductility, and ensure good bendability. The area fraction of martensite is preferably 5.0% or greater and 25.0% or less.

Note that the area fractions of ferrite and martensite can be determined by using the following procedure. A cross section (L cross section) along a sheet thickness and parallel to a rolling direction of the steel sheet is polished. Thereafter, the cross section is etched with 3 vol. % nital. A ¼ sheet thickness position (a position corresponding to ¼ of the sheet thickness in a depth direction, with respect to a surface of the steel sheet) is observed with an SEM (scanning electron microscope) at a magnification of 2000×, through 10 fields of view in a 60 μm×45 μm region. From the obtained images of the microstructures, area fractions of each of the constituents (ferrite and martensite) are calculated for the 10 fields of view by using Image-Pro (Media Cybernetics, Inc.). The area fractions are determined as an average of the calculated values. In the images of the microstructures, ferrite is observed as a gray constituent (matrix constituent), and martensite is observed as a white constituent.

Volume Fraction of Retained Austenite: 12.0% or Greater

A volume fraction of retained austenite is a very important constituent element according to aspects of the present invention. In particular, retained austenite needs to be present in a volume fraction of 12.0% so as to ensure good uniform ductility and good bendability. The volume fraction of the retained austenite is preferably greater than or equal to 14.0%.

Note that the volume fraction of retained austenite can be determined by using the following procedure. The steel sheet is polished until a ¼ sheet thickness surface (a surface corresponding to ¼ of the sheet thickness in a depth direction, with respect to a surface of the steel sheet) is exposed. The volume fraction is determined by measuring an X-ray diffraction intensity of the ¼ sheet thickness surface. Mo-Kα radiation is used as the incident X-ray. An intensity ratio of a peak integrated intensity of the {111}, {200}, {220}, or {311} plane of the retained austenite to a peak integrated intensity of the {110}, {200}, or {211} plane of the ferrite is calculated for all the twelve combinations. The volume fraction can be determined as an average of the calculated values.

Average Grain Size of Ferrite: 5.0 μm or Less

An average grain size of the ferrite is a very important constituent element according to aspects of the present invention. In instances where the ferrite grains are refined, a yield-point elongation (YP-EL) can be exhibited, and the bendability of the steel sheet is improved. Accordingly, the average grain size of the ferrite needs to be less than or equal to 5.0 μm so as to ensure the yield-point elongation (YP-EL) of 1.0% or greater and good bendability. Preferably, the average grain size of the ferrite is less than or equal to 4.0 μm.

Average Grain Size of Retained Austenite: 2.0 μm or Less

In instances where the retained austenite grains are refined, the stability of the retained austenite itself is improved, which in turn improves the ductility, particularly, uniform ductility, of the steel sheet. In addition, during a bendability test, strain-induced martensite, which results from the transformation of the retained austenite due to bending deformation, is inhibited from experiencing crack propagation at grain boundaries, that is, the steel sheet, consequently, has improved bendability and improved bending crush performance and axial crush performance. Accordingly, an average grain size of the retained austenite needs to be less than or equal to 2.0 μm so as to ensure good ductility, particularly, good uniform ductility, good bendability, good bending crush performance, and good axial crush performance. Preferably, the average grain size of the retained austenite is less than or equal to 1.5 μm.

Note that the average grain sizes of the ferrite and the retained austenite can be determined as follows. By using Image-Pro, mentioned above, areas of the ferrite grains and areas of the retained austenite grains are determined, their equivalent circular diameters are calculated, and the calculated values are averaged. For distinguishing between the retained austenite and the martensite, phase maps from EBSD (electron backscattered diffraction) were used.

Value Obtained by Dividing Mn Content (Mass %) of Retained Austenite by Mn Content (Mass %) of Steel: 1.50 or Greater A value obtained by dividing a Mn content (mass %) of the retained austenite by a Mn content (mass %) of the steel is to be greater than or equal to 1.50. This is a very important constituent element according to aspects of the present invention. Ensuring good ductility, particularly, good uniform ductility, requires a large volume fraction of stable retained austenite enriched with Mn. Furthermore, in a bending crush test or an axial crush test at room temperature, heat due to a high strain rate is generated, and, partially, heat of phase transformation due to transformation from retained austenite to strain-induced martensite is generated; consequently, a temperature becomes 150° C. or greater as a result of self-heating alone. At 150° C., austenite does not easily transform into strain-induced martensite. As a result, in bending crush or axial crush, the steel sheet does not crack but rather collapses, before a later stage of deformation, and, in particular, in axial crush, the steel sheet collapses into a bellows shape without cracking. Accordingly, a high impact absorbed energy is achieved. Furthermore, a value obtained by dividing a volume fraction Vγa by a volume fraction Vγb becomes large. The volume fraction Vγa is a volume fraction of retained austenite in a fractured portion of a tensile test specimen after a warm tensile test at 150° C. The volume fraction Vγb is a volume fraction of retained austenite before the warm tensile test at 150° C. Preferably, the value obtained by dividing a Mn content (mass %) of the retained austenite by a Mn content (mass %) of the steel is greater than or equal to 1.70. The Mn content of the retained austenite can be determined as follows. In a cross section along the rolling direction at a ¼ sheet thickness position, a Mn distribution state in each of the phases is quantitatively determined by using an FE-EPMA (field emission electron probe micro analyzer). The Mn amount is analyzed for 30 retained austenite grains and 30 ferrite grains, and the results are averaged.

15% or More of all Retained Austenite Grains in Retained Austenite have Aspect Ratio of 3.0 or Greater, and 15% or More of all Retained Austenite Grains in Retained Austenite have Aspect Ratio of Less than 2.0

In accordance with aspects of the present invention, 15% or more of all the retained austenite grains in the retained austenite have an aspect ratio of 3.0 or greater (such retained austenite is referred to as lath retained austenite). This improves ductility, particularly, uniform ductility, various types of bendability, bending crush performance, and axial crush performance. 15% or more of all the retained austenite grains in the retained austenite have an aspect ratio of less than 2.0 (such retained austenite is referred to as blocky retained austenite). Accordingly, in a bending crush test or an axial crush test at room temperature, heat due to a high strain rate is generated, and, partially, heat of phase transformation due to transformation from retained austenite to strain-induced martensite is generated; consequently, a temperature becomes 150° C. or greater as a result of self-heating alone. At 150° C., austenite does not easily transform into strain-induced martensite. As a result, in bending crush or axial crush, the steel sheet does not crack but rather collapses, before a later stage of deformation, and, in particular, in axial crush, the steel sheet collapses into a bellows shape without cracking. Accordingly, a high impact absorbed energy is achieved.

Value Obtained by Dividing Volume Fraction Vγa by Volume Fraction Vγb is 0.40 or Greater, where Volume Fraction Vγa is Volume Fraction of Retained Austenite in Fractured Portion of Tensile Test Specimen After Warm Tensile Test at 150° C., and Volume Fraction Vγb is Volume Fraction of Retained Austenite Before Warm Tensile Test at 150° C.

A value obtained by dividing a volume fraction Vγa by a volume fraction Vγb is to be greater than or equal to 0.40, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C. This is a very important constituent element according to aspects of the present invention. When the value obtained by dividing a volume fraction Vγa by a volume fraction Vγb is greater than or equal to 0.40, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C., austenite does not easily transform into strain-induced martensite in an instance in which a warm tensile test is performed at 150° C. Accordingly, in bending crush or axial crush, the steel sheet does not crack but rather collapses, before a later stage of deformation, and, in particular, in axial crush, the steel sheet collapses into a bellows shape without cracking. Accordingly, a high impact absorbed energy is achieved. Accordingly, the value obtained by dividing a volume fraction Vγa by a volume fraction Vγb is specified to be greater than or equal to 0.40, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C. Preferably, the value is greater than or equal to 0.50. Note that the "fractured portion of a tensile test specimen after a warm tensile test at 150° C." refers to a ¼ sheet thickness cross-sectional position along a longitudinal direction (direction parallel to the rolling direction of the steel sheet) of the tensile test specimen 0.1 mm inward of the fractured portion.

Amount of Diffusible Hydrogen in Steel: 0.50 Mass-Ppm or Less

It is preferable that an amount of diffusible hydrogen in steel be less than or equal to 0.50 mass-ppm so as to ensure good bendability. More preferably, the amount of diffusible hydrogen in steel is within a range less than or equal to 0.30 mass-ppm. The amount of diffusible hydrogen in steel was calculated in the following manner. A test specimen having a length of 30 mm and a width of 5 mm was cut from an annealed steel sheet, a coated layer was removed by grinding, and subsequently, an amount of diffusible hydrogen in steel and an emission peak of the diffusible hydrogen were measured. The emission peak was measured by using thermal desorption spectrometry (TDS), and the heating rate was 200° C./hour. Note that the amount of diffusible hydrogen in steel was an amount of hydrogen detected at temperatures less than or equal to 300° C. Furthermore, the test specimen to be used in the calculation of the amount of diffusible hydrogen in steel is not limited to a test specimen cut from an annealed steel sheet. The test specimen may be cut, for example, from a formed product, such as an automotive part, or from an assembled motor vehicle body.

In the microstructure of the high strength steel sheet according to aspects of the present invention, tempered martensite, bainite, tempered bainite, and carbides, such as cementite, may be present in an area fraction of less than or equal to 8%, in addition to the ferrite, martensite, and retained austenite. Even in such a case, the advantageous effects according to aspects of the present invention are not compromised.

The high strength steel sheet according to aspects of the present invention may have a zinc coated layer or an aluminum coated layer on a surface of the steel sheet.

Now, manufacturing conditions for the high strength steel sheet according to aspects of the present invention will be described.

Heating Temperature for Steel Slab

A heating temperature for a steel slab is not particularly limited and is preferably within a temperature range of 1100° C. or greater and 1300° C. or less. Precipitates that exist at the time of heating the steel slab exist as coarse precipitates in the finally obtained steel sheet and do not contribute to the strength of the steel. Accordingly, it is necessary to redissolve Ti and/or Nb precipitates that have been precipitated during casting. If the heating temperature for the steel slab is less than 1100° C., sufficient dissolution of carbides is difficult, which can cause a problem. The problem is, for example, an increased risk of the occurrence of a malfunction during hot rolling due to an increased rolling load. Accordingly, it is preferable that the heating temperature for the steel slab be greater than or equal to 1100° C. Furthermore, from the standpoint of scaling-off defects present in a surface layer of the slab, such as bubbles and segregation, thereby reducing cracks and irregularities on a surface of the steel sheet to achieve a smooth surface of the steel sheet, it is preferable that the heating temperature for the steel slab be greater than or equal to 1100° C. On the other hand, if the heating temperature for the steel slab is greater than 1300° C., a scale loss increases as a result of an increase in an oxidation amount. Accordingly, it is preferable that the heating temperature for the steel slab be less than or equal to 1300° C. More preferably, the heating temperature for the steel slab is greater than or equal to 1150° C. and less than or equal to 1250° C.

It is preferable that the steel slab be manufactured by using a continuous casting process so that macro segregation can be prevented. Alternatively, the steel slab can be manufactured by using an ingot casting process, a thin slab casting process, or the like. Furthermore, after the steel slab is manufactured, a conventional process may be performed, in which the slab is cooled to room temperature and is thereafter reheated; or an energy-saving process can be suitably used. Examples of the energy-saving process include hot charge rolling and hot direct rolling, in which the warm slab is directly charged into a heating furnace without being cooled to room temperature, or the slab is kept hot for a short period of time and thereafter immediately hot rolled. The steel slab is subjected to rough rolling under typical conditions to form a transfer bar. When the heating temperature is low, it is preferable that the transfer bar be heated before finish rolling by using a bar heater or the like, from the standpoint of preventing a malfunction during hot rolling.

Finish Rolling Delivery Temperature in Hot Rolling

The heated steel slab is hot-rolled by rough rolling and finish rolling to form a hot rolled steel sheet. In this instance, if the finish rolling delivery temperature is greater than 1,000° C., an amount of formation of an oxide (scale) rapidly increases, which roughens the interface between the base metal and the oxide; consequently, surface quality after pickling and cold rolling may be degraded. Furthermore, if a residue of the hot rolling scale, or the like, exits on a portion after pickling, the ductility and bendability of the steel sheet may be adversely affected. On the other hand, if the finish rolling delivery temperature is less than 750° C., a rolling reduction ratio for rolling in the non-recrystallization state of austenite is high; consequently, an abnormal texture develops, which results in a significant in-plane anisotropy in a final product, and as a result, uniformity of the material quality (stability of mechanical properties) may be compromised. Accordingly, it is preferable that the finish rolling delivery temperature in the hot rolling be within a temperature range of 750° C. or greater and 1,000° C. or less. More preferably, the finish rolling delivery temperature is 800° C. or greater and 950° C. or less.

Coiling Temperature for Coiling after Hot Rolling

If a coiling temperature for coiling after hot rolling is greater than 750° C., the grain size of ferrite in the microstructure of the hot rolled steel sheet increases, and as a result, ensuring good bendability of a final annealed steel sheet may become difficult. Furthermore, the surface quality of the final material may be degraded. On the other hand, if the coiling temperature for coiling after hot rolling is less than 300° C., the strength of the hot rolled steel sheet increases; consequently, a rolling load in cold rolling increases, a shape defect of the steel sheet occurs, and, therefore productivity may be reduced. Accordingly, it is preferable that the coiling temperature for coiling after hot rolling be within a temperature range of 300° C. or greater and 750° C. or less. More preferably, the coiling temperature for coiling after hot rolling is 400° C. or greater and 650° C. or less.

Note that in the hot rolling, the finish rolling may be performed continuously by joining rough-rolled steel sheets together. Furthermore, the rough-rolled steel sheets may be temporarily coiled. Furthermore, the finish rolling may be carried out, partially or wholly, by lubrication rolling so that the rolling load in the hot rolling can be reduced. Performing lubrication rolling is effective from the standpoint of achieving a uniform shape and material quality of the steel sheet. Note that it is preferable that a coefficient of friction for the lubrication rolling be within a range of 0.10 or greater and 0.25 or less. The hot rolled steel sheet manufactured as described is subjected to pickling. Pickling can remove the oxide on the surface of the steel sheet and is, therefore, important for ensuring good chemical convertibility and a good quality of a coating of the high strength steel sheet that is the final product. The pickling may be performed in a single step or in multiple steps.

After the pickling, a heat treatment is performed on the hot rolled steel sheet under the following conditions.

Heat Treatment of Hot Rolled Steel Sheet: the hot rolled steel sheet is held within a temperature range of $Ac_1$ transformation temperature or greater and "$Ac_1$ transformation temperature+150° C." or less for a period of more than 21,600 seconds and 259,200 seconds or less If the hot rolled steel sheet is held within a temperature range less than an $Ac_1$ transformation temperature, within a temperature range greater than "the $Ac_1$ transformation temperature+150° C.", and/or for a period of 21,600 seconds or less, the enrichment of the austenite with Mn does not progress sufficiently. As a result, it is difficult to ensure that, after final annealing, a sufficient volume fraction of retained austenite exists, the average grain size of the retained austenite is less than or equal to 2.0 μm, and the value obtained by dividing a Mn content (mass %) of the retained austenite by a Mn content (mass %) of the steel is greater than or equal to 1.50. Consequently, the ductility, particularly, uniform ductility, and the bendability of the steel sheet may be reduced. Furthermore, it may become difficult to ensure that the value obtained by dividing a volume fraction Vγa by a volume fraction Vγb is greater than or equal to 0.40, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C. Preferably, the temperature range is a temperature range of "the $Ac_1$ transformation temperature+30° C." or greater and "the $Ac_1$ transformation temperature+130° C." or less. Furthermore, it is preferable that the holding time be less than or equal to 259,200 seconds. If the holding time is greater than 259,200 seconds, the enrichment of the austenite with Mn no longer progresses; consequently, the effect of ensuring after-final-annealing ductility, particularly, after-final-annealing uniform ductility, is reduced, and in addition, cost may increase.

Average Cooling Rate Over Temperature Range of 550° C. to 400° C. for Cooling after Annealing of Hot Rolled Steel Sheet: 5° C./Hour or Greater and 200° C./Hour or Less Even in the case of austenite enriched with Mn during an annealing process for the hot rolled steel sheet, the austenite becomes coarse when the steel sheet is held for a long time, and such austenite inhibits pearlite transformation if an average cooling rate over a temperature range of 550° C. to 400° C. is greater than 200° C./hour. Utilizing an appropriate amount of pearlite enables the formation of fine ferrite and fine retained austenite during an annealing process after cold rolling and is, therefore, effective for ensuring the yield-point elongation (YP-EL) of 1.0% or greater and ensuring various types of bendability, bending crush performance, and axial crush performance. Furthermore, in the instance where an appropriate amount of pearlite is utilized, it is easy to ensure that 15% or more of all the retained austenite grains in the retained austenite of the final microstructure have an aspect ratio of 3.0 or greater (such retained austenite is referred to as lath retained austenite), and as a result, ductility, particularly, uniform ductility, various types of bendability, bending crush performance, and axial crush performance are improved. Accordingly, the average cooling rate over a temperature range of 550° C. to 400° C. for cooling after an annealing process for the hot rolled steel sheet is specified to be less than or equal to 200° C./hour. On the other hand, if the average cooling rate over a temperature range of 550° C. to 400° C. is less than 5° C./hour, it is difficult to ensure that a sufficient volume fraction of retained austenite exists after final annealing, and in addition, the grain sizes of the ferrite and the retained austenite become large; consequently, ensuring the yield-point elongation (YP-EL) of 1.0% or greater is difficult. As a result, it may become difficult to ensure good ductility, particularly, good uniform ductility, various types of bendability, bending crush performance, and axial crush performance. Preferably, the average cooling rate is 10° C./hour or greater and 170° C./hour or less. Note that the average cooling rate over a temperature range of 550° C. to 400° C. for cooling after an annealing process for the hot rolled steel sheet was determined as the result of (550° C.-400° C.)/(the time needed to reduce the temperature from 550° C. to 400° C.).

The steel sheet that has undergone a heat treatment after the hot rolling is subjected to a pickling process as necessary, which is performed in accordance with a common method. The resulting steel sheet is cold-rolled to form a cold rolled steel sheet. A rolling reduction ratio for the cold rolling is not particularly limited and is preferably within a range of 20% or greater and 85% or less. If the rolling reduction ratio is less than 20%, unrecrystallized ferrite may remain, which may reduce the ductility of the steel sheet. On the other hand, if the rolling reduction ratio is greater than 85%, a load in the cold rolling increases, and, consequently, a threading problem may arise.

Next, the resulting cold rolled steel sheet is subjected to heat treatments, which are described below.

Heating Cold Rolled Steel Sheet at Average Heating Rate of 8° C./Second or Greater and 50° C./Second or Less Through Temperature Range of 400° C. to $Ac_1$ Transformation Temperature If the cold rolled steel sheet is heated at an average heating rate of less than 8° C./second through a temperature range of 400° C. to the $Ac_1$ transformation temperature, recovery and recrystallization progress excessively, and, consequently, the microstructure becomes coarse. As a result, the ferrite in the final microstructure has a large grain size, and, therefore, enabling the exhibition of a yield-point elongation (YP-EL) and ensuring good bendability are difficult. If the cold rolled steel sheet is heated at an average heating rate of greater than 50° C./second through the temperature range of 400° C. to the $Ac_1$ transformation temperature, a large amount of undissolved pearlite remains, and, consequently, an excessively high volume fraction of martensite exists after a second annealing process for the cold rolled steel sheet. Accordingly, ensuring good ductility, particularly, good uniform ductility is difficult, and ensuring various types of bendability, bending crush performance, and axial crush performance is difficult.

First Heat Treatment of Cold Rolled Steel Sheet: The Cold Rolled Steel Sheet is Held within a Temperature Range of the $Ac_1$ Transformation Temperature or Greater and "the $Ac_1$ Transformation Temperature+150° C." or Less for a Period of 20 Seconds or More and 3,600 Seconds or Less If the cold rolled steel sheet is held within a temperature range less than the $Ac_1$ transformation temperature and/or for a period of less than 20 seconds, a carbide that is formed during heating may remain undissolved. As a result, ensuring sufficient volume fractions of martensite and retained austenite is difficult, and, consequently, the tensile strength of the steel sheet may be reduced. In addition, if the cold rolled steel sheet is held within a temperature range less than the $Ac_1$ transformation temperature, it is difficult to ensure that 15% or more of all the retained austenite grains in the retained austenite have an aspect ratio of less than 2.0 (such retained austenite is referred to as blocky retained austenite). Furthermore, if the cold rolled steel sheet is held within a temperature range greater than "the $Ac_1$ transformation temperature+150° C.", an excessively high volume fraction of martensite is formed. Furthermore, the average grain sizes of the ferrite and the retained austenite become large. As a result, the yield-point elongation (YP-EL) of 1.0% or greater may not be achieved, and, consequently, ensuring good ductility, particularly, good uniform ductility, various types of bendability, bending crush performance, and axial crush performance may be difficult. Preferably, the temperature range within which the cold rolled steel sheet is to be held is the $Ac_1$ transformation temperature or greater and the "$Ac_1$ transformation temperature+130° C." or less. Furthermore, if the cold rolled steel sheet is held for a period of greater than 3,600 seconds, the average grain sizes of the ferrite and the retained austenite become large. As a result, the yield-point elongation (YP-EL) of 1.0% or greater may not be achieved, and, consequently, ensuring good ductility, particularly, good uniform ductility, various types of bendability, bending crush performance, and axial crush performance may be difficult. More preferably, the holding time is 50 seconds or more and 1,800 seconds or less.

After the first heat treatment of the cold rolled steel sheet, the cold rolled steel sheet is cooled to room temperature. After being cooled to room temperature, the cold rolled steel sheet may, as necessary, be subjected to a pickling process, which is performed in accordance with a common method. Furthermore, after the first heat treatment of the cold rolled steel sheet, the cold rolled steel sheet is cooled to room temperature and may, as necessary, be subjected to a second heat treatment, which is performed under the following conditions.

Second Heat Treatment of Cold Rolled Steel Sheet: The Cold Rolled Steel Sheet is Held within a Temperature Range of 50° C. or Greater and 300° C. or Less for a Period of 1,800 Seconds or More and 259,200 Seconds or Less If the cold rolled steel sheet is held within a temperature range less than 50° C. or for a period of less than 1,800 seconds, diffusible hydrogen in steel is not released from the steel sheet, and as a result, various types of bendability of the steel sheet may be reduced. On the other hand, if the cold rolled steel sheet is held within a temperature range greater than 300° C. or for a period of more than 259,200 seconds, retained austenite is decomposed, and, consequently, a sufficient volume fraction of retained austenite cannot be obtained. As a result, the ductility, particularly, uniform ductility, of the steel sheet may be reduced. Note that after the second heat treatment of the cold rolled steel sheet, the cold rolled steel sheet may be cooled to room temperature. Furthermore, in instances where a coating process is performed, the second heat treatment of the cold rolled steel sheet is to be performed after the coating process, which will be described later. More preferably, the temperature range is 70° C. or greater and 200° C. or less. Furthermore, more preferably, the holding time is 3,600 seconds or more and 216,000 seconds or less.

Performing Coating Process

A coating process may be performed on the cold rolled steel sheet produced as described above. Examples of the coating process include hot-dip galvanizing processes, electrogalvanizing processes, and hot-dip aluminum coating processes. Accordingly, a high strength steel sheet having a galvanized layer or an aluminum coated layer on a surface of the steel sheet can be obtained. Note that the "hot-dip galvanizing" is to be construed as including hot-dip galvannealing. Furthermore, as described above, in instances where a coating process is performed, the second heat treatment of the cold rolled steel sheet may be performed after the coating process, as necessary.

In instances where a hot-dip galvanizing process is to be performed, the hot-dip galvanizing process is performed, for example, by immersing the steel sheet, which has undergone the annealing process, in a hot-dip galvanizing bath having a temperature range of 440° C. or greater and 500° C. or less and, subsequently, adjusting a coating weight by using gas wiping or the like. Note that, preferably, the hot-dip galvanizing bath to be used is a hot-dip galvanizing bath having an Al content of 0.08% or greater and 0.18% or less. In instances where an alloying process is to be performed on the hot-dip zinc coating, the alloying process is performed on the hot-dip zinc coating within a temperature range of 450° C. or greater and 600° C. or less after the hot-dip galvanizing process. If the alloying process is performed at a temperature greater than 600° C., untransformed austenite transforms into pearlite, and, consequently, the desired volume fraction of retained austenite cannot be ensured. As a result, the ductility, particularly, uniform ductility, of the steel sheet may be reduced. Accordingly, in instances where an alloying process is to be performed on the hot-dip zinc coating, it is preferable that the alloying process be performed on the hot-dip zinc coating within a temperature range of 450° C. or greater and 600° C. or less.

Furthermore, in instances where an electrogalvanizing process is to be performed, a thickness of the coating is not particularly limited and is preferably within a range of 5 μm to 15 μm.

Furthermore, in instances where a hot-dip aluminum coating process is to be performed, the hot-dip aluminum coating process is performed by immersing the cold rolled steel sheet, which was produced by performing cold-rolled-sheet annealing thereon, in an aluminum coating bath having a temperature of 660° C. to 730° C. and, subsequently, adjusting a coating weight by using gas wiping or the like. In instances where the steel is compatible with an aluminum coating bath temperature that is within a temperature range of the $Ac_1$ transformation temperature or greater and the $Ac_1$ transformation temperature+100° C. or less, the hot-dip aluminum coating process enables the formation of further refined and stable retained austenite; consequently, the ductility, particularly, uniform ductility, can be further improved.

Note that in instances where a high strength hot-dip galvanized steel sheet, a high strength hot-dip galvannealed steel sheet, a high strength hot-dip aluminum coated steel sheet, or a high strength electrogalvanized steel sheet process is to be manufactured, a good coating quality can be finally obtained by performing a pickling process before a heat treatment that is performed immediately before the coating (for example, between the completion of the hot rolling coiling and the first heat treatment or between a heat treatment that is performed immediately before the coating (a third heat treatment) and a heat treatment is performed immediately before the third heat treatment (the second heat treatment)). This is because, in this case, oxides are inhibited from existing on a surface immediately before the coating process, and, therefore, coating defects due to an oxide are inhibited. More specifically, during the heat treatments, oxidizable elements (e.g., Mn, Cr, and Si) form oxides and are concentrated on the surface of the steel sheet, and, accordingly, after the heat treatments, an oxidizable element depletion layer exists on the surface of the steel sheet (immediately below the oxides). In the subsequent pickling process, the oxides of the oxidizable elements are removed, and, accordingly, the oxidizable element depletion layer appears on the surface of the steel sheet. Consequently, during the subsequent third heat treatment, surface oxidation due to oxidizable elements is inhibited.

Other conditions for the manufacturing method are not particularly limited. It is preferable, from the standpoint of productivity, that the annealing described above be performed in a continuous annealing line. Furthermore, it is preferable that the series of processes, including annealing, hot-dip galvanizing, and an alloying process for a hot-dip zinc coating, be performed in a CGL (continuous galvanizing line), which is a hot-dip galvanizing line. Note that the high strength hot-dip galvanized steel sheet may be subjected to skin pass rolling so that shape correction, an adjustment of surface roughness, and the like can be achieved. Preferably, a rolling reduction ratio for the skin pass rolling is greater than or equal to 0.1% and less than or equal to 2.0%. If the rolling reduction ratio is less than 0.1%, the effects are small, and control is difficult. If the rolling reduction ratio is greater than 2.0%, productivity is significantly reduced. Note that the skin pass rolling may be performed on-line or off-line. Furthermore, the skin pass rolling may be performed in a single step with a desired rolling reduction ratio or may be performed in multiple steps. Furthermore, any of various coating processes, such as resin coating and fats coating, may be performed.

The high strength steel sheet according to aspects of the present invention can be used in an impact absorbing portion of an impact absorbing member in motor vehicles. Specifically, the high strength steel sheet according to aspects of the present invention can be used in an impact absorbing portion of impact absorbing members that are provided with an impact absorbing portion that absorbs impact energy by undergoing bending crush and deformation and in an impact absorbing portion of impact absorbing members that are provided with an impact absorbing portion that absorbs impact energy by undergoing axial crush and deformation into a bellows shape. Impact absorbing members having an impact absorbing portion formed of the high strength steel sheet according to aspects of the present invention have a yield-point elongation (YP-EL) of 1.0% or greater and a tensile strength (TS) of 980 MPa or greater and also have excellent uniform ductility, bendability, and crush performance. Accordingly, the impact absorbing members are excellent in impact absorption.

EXAMPLES

Steels having the chemical composition shown in Table 1, with the balance being Fe and incidental impurities, were produced in a converter by using a steelmaking process. The steels were cast by using a continuous casting process to form steel slabs. The obtained steel slabs were hot rolled and thereafter pickled. Subsequently, the resulting steel sheets were subjected to a heat treatment of hot rolled steel sheets, cooling, cold rolling, and a heat treatment of cold rolled steel sheets, which were performed under the conditions shown in Tables 2-1 and 2-2. Accordingly, high strength cold rolled steel sheets (CR) were obtained. Some of the steel sheets were further subjected to a hot-dip galvanizing process (including a process in which an alloying process was performed after the hot-dip galvanizing process), a hot-dip aluminum coating process, or an electrogalvanizing process to form hot-dip galvanized steel sheets (GI), hot-dip galvannealed steel sheets (GA), hot-dip aluminum coated steel sheets (Al), and electrogalvanized steel sheets (EG). Regarding the hot-dip galvanizing baths, a zinc bath containing 0.19 mass % Al was used for the hot-dip galvanized steel sheets (GI). A zinc bath containing 0.14 mass % Al was used for the hot-dip galvannealed steel sheets (GA), and a temperature of the bath was 465° C. A coating weight per side was 45 g/m$^2$ (two-side coating), and, for GA, an Fe concentration in the coated layer was adjusted to fall within a range of 9 mass % or greater and 12 mass % or less. Furthermore, a temperature of a hot-dip aluminum coating bath for the hot-dip aluminum coated steel sheets was 680° C. The obtained steel sheets were evaluated for a microstructure, tensile properties, bendability, bending crush performance, and axial crush performance. The $Ac_1$ transformation temperature was determined by using the following equation.

$Ac_1$ Transformation Temperature (° C.)

$$=751-16\times(\%\ C)+11\times(\%\ Si)-28\times(\%\ Mn)-5.5\times(\%\ Cu)-16\times(\%\ Ni)+13\times(\%\ Cr)+3.4\times(\%\ Mo)$$

The microstructures of the steel sheets were determined by performing an observation in accordance with the method described above.

The tensile properties were determined by using the following method.

A tensile test at room temperature was performed in accordance with JIS Z 2241 (2011) by using a JIS No. 5 test specimen, which was obtained by cutting a sample in a manner such that a tensile direction was perpendicular to the rolling direction of the steel sheet. Accordingly, TS (tensile strength), EL (total elongation), YP-EL (yield-point elongation), and U.EL (uniform elongation), at room temperature, were measured. In instances where the following conditions were satisfied, a determination was made that the corresponding tensile property was good.

<TS is 980 MPa or Greater and Less than 1,180 MPa>

YP-EL≥1.0%, EL≥22%, and U.EL≥18%

<TS is 1,180 MPa or Greater>

YP-EL≥1.0%, EL≥18%, and U.EL≥14%

Furthermore, a warm tensile test at 150° C. was performed in accordance with JIS G 0567 (2012) by using a JIS No. 5 test specimen, which was obtained by cutting a sample in a manner such that a tensile direction was perpendicular to the rolling direction of the steel sheet. Both the volume fraction Vγa of retained austenite in a fractured portion of the tensile test specimen after the warm tensile test at 150° C. and the volume fraction Vγb of retained austenite before the warm tensile test at 150° C. were calculated by using X-ray diffraction.

A material test for evaluating vertical-wall-portion bend cracking was conducted by performing a contact bending test after a U-bending test. The test specimen used had a size of 60 mm (C)×30 mm (L) (C: a C direction, which is a direction along a direction perpendicular to the rolling direction of the steel sheet, L: an L direction, which is a direction along the rolling direction), with both of widthwise edge surfaces being finish-grinded. The U-bending was performed in a longitudinal C direction (length of a bend apex line: 30 mm (L)) by using a hydraulic bending test machine, in a manner in which a bending radius (R) of the punch was 4 mm, which was a bending radius at which cracking did not occur in any of the samples, and a stroke rate was 1,500 mm/minute (high rate). Subsequently, the contact bending was performed on the U-bent test specimen. The contact bending was performed by using a hydraulic bending test machine, in a manner in which a thickness of a spacer, which was held between the test machine and the steel sheet, was varied, the stroke rates were 20 mm/minute (low rate) and 1,500 mm/minute (high rate), a pressing load was 10 tons, a pressing time was 3 seconds, and a bend apex line of the U-bent test specimen and a pressing direction were perpendicular to each other. Note that the thickness of the spacer was varied in increments of 0.5 mm, and a cracking threshold spacer thickness was determined as a minimum spacer thickness at which a crack measuring 0.5 mm or greater along the bend apex line was not formed. In instances where the cracking threshold spacer thickness was 5.0 mm or less, a rating of "good" was given.

A material test for evaluating four-fold bend cracking was conducted by performing handkerchief bending. The test specimen used had a size of 60 mm (C)×100 mm (L), with all of the edge surfaces being finish-grinded. U-bending was performed in a longitudinal L direction (length of a bend apex line: 60 mm (C)) by using a hydraulic bending test machine, in a manner in which the bending radius R of the punch was 4 mm, which was a bending radius at which cracking did not occur in any of the samples, and the stroke rate was 1,500 mm/minute (high rate). Subsequently, contact bending was performed on the U-bent test specimen. The contact bending was performed by using a hydraulic bending test machine, in a manner in which a thickness of a spacer was 5 mm, which was a thickness at which cracking did not occur in any of the samples; the stroke rate was 1,500 mm/minute, which is relatively high; the pressing load was 10 tons; the pressing time was 3 seconds; and a bend apex line of the U-bent test specimen and a pressing direction were perpendicular to each other. Subsequently, the resulting contact-bent sample, which was folded in two places, was rotated 90° and subjected to U-bending for folding the sample in four places. The U-bending was performed in a longitudinal C direction (length of a bend apex line: 50 mm (L)) by using a hydraulic bending test machine, in a manner in which the bending radius R of the punch was varied, the stroke rate was 1,500 mm/minute, which is relatively high, and a bend apex line of the contact-bent test specimen and the apex line of the U-bending for folding the sample in four places were perpendicular to each other. In the U-bending for folding the sample in four places, a cracking threshold R/t (t: sheet thickness) was determined as a minimum R/t at which a crack measuring 0.5 mm or greater was not formed inside and outside of the bend apex. In instances where R/t≤5.0, a rating of "good" was given.

A material test for evaluating apex-line-portion bend cracking was performed as follows. A test specimen was rotated 90° after being subjected to V-bending, and the test specimen was then subjected to U-bending. The test specimen used was a test specimen having a size of 75 mm (C)×55 mm (L), with all of the edge surfaces being finish-grinded. The V-bending was performed in a longitudinal L direction (length of a bend apex line: 75 mm (C)) by using an Autograph, which is a product of Shimadzu Corporation, in a manner in which the bending radius R of the punch was 5 mm, which was a bending radius at which cracking did not occur in any of the samples, the punch was pushed at a punch bending angle of 90° and a punch stroke rate of 20 mm/minute, the pressing load was 10 tons, and the pressing time was 3 seconds. Subsequently, the V-bent test specimen was reverse bent to be flattened. Subsequently, the U-bending was performed in a manner such that the bend apex line of the V-bending and an apex line of the U-bending were perpendicular to each other. The 90° rotation U-bending was performed in a longitudinal C direction (length of a bend apex line: 55 mm (L)) by using a hydraulic bending test machine, in a manner in which the bending radius of the punch was varied, and the stroke rate was 1,500 mm/minute, which is relatively high.

The apex-line-portion bend cracking was evaluated by performing two types of bending tests: an outward bending test and an inward bending test. In the outward bending test, the apex side of the V-bending, which was performed first, was the same as the apex side of the 90° rotation U-bending, which was performed next, and, therefore, the bend apex line positions were located outside of the 90° rotation U-bending test specimen. In the inward bending test, the apex side of the V-bending, which was performed first, was different from the apex side of the 90° rotation U-bending, which was performed next, and, therefore, the bend apex line positions were located inside and outside of the 90° rotation U-bending test specimen. In the 90° rotation-U-bent test specimen, the presence or absence of a crack at the tip of the bend was determined at a bend apex line position that was subjected to bending twice. Specifically, the cracking threshold R/t was determined for each of the two types of bending tests with the outward-bent test specimen and the inward-bent test specimen. When the R/t values were the same, the R/t value was used as the result of the apex-line-portion bend cracking evaluation, and when the R/t values were different, the larger R/t value was used as the result of the apex-line-portion bend cracking evaluation. The cracking threshold R/t, which was a minimum R/t at which a crack measuring 0.5 mm or greater was not formed, was evaluated. In instances where R/t≤5.0, a rating of "good" was given.

Regarding crush performance, a bending crush test was performed as described below, and determinations were made based on the state of deformation. Bending was performed to form a member having a hat-shaped cross section. A steel sheet of the same type was joined to the member by using spot welding so that the steel sheet could serve as a backing. Next, the member was struck with a weight of 100 kgf in a width direction at a speed corresponding to 36 km/hour, thereby being crushed. Subsequently, the state of deformation of the member was visually examined. In instances where the member collapsed without cracking, a rating of "○" was given, and in instances where cracking occurred, a rating of "x" was given. Regarding crush performance, an axial crush test was performed as described below, and determinations were made based on the form of deformation. Bending was performed to form a member having a hat-shaped cross section. A steel sheet of the same type was joined to the member by using spot welding so that the steel sheet could serve as a backing. Next, the member was struck with a weight of 300 kgf in an axial direction at a speed corresponding to 36 km/hour, thereby being crushed. Subsequently, the state of deformation of the member was visually examined. In instances where the member collapsed without cracking, a rating of "○" was given, and in instances where cracking occurred, a rating of "x" was given.

The evaluation results are shown in Tables 3-1 and 3-2 below.

TABLE 1

| Steel | Chemical composition (mass %) | | | | | | | | | | | | | |
|---|---|---|---|---|---|---|---|---|---|---|---|---|---|---|
| type | C | Si | Mn | P | S | N | Al | Ti | Nb | V | W | B | Ni | Cr |
| A | 0.134 | 0.42 | 4.08 | 0.008 | 0.0010 | 0.0031 | 0.032 | — | — | — | — | — | — | — |
| B | 0.144 | 0.15 | 5.08 | 0.011 | 0.0009 | 0.0022 | 0.023 | — | — | — | — | — | — | — |
| C | 0.133 | 0.38 | 3.73 | 0.034 | 0.0014 | 0.0033 | 0.039 | — | — | — | — | — | — | — |
| D | 0.127 | 0.14 | 4.32 | 0.011 | 0.0044 | 0.0038 | 0.033 | — | — | — | — | — | — | — |
| E | 0.045 | 0.88 | 5.59 | 0.014 | 0.0010 | 0.0042 | 0.040 | — | — | — | — | — | — | — |
| F | 0.175 | 1.70 | 4.82 | 0.008 | 0.0015 | 0.0045 | 0.036 | — | — | — | — | — | — | — |
| G | 0.129 | 0.04 | 5.24 | 0.015 | 0.0012 | 0.0032 | 0.034 | — | — | — | — | — | — | — |
| H | 0.012 | 0.68 | 4.82 | 0.013 | 0.0020 | 0.0042 | 0.031 | — | — | — | — | — | — | — |
| I | 0.129 | 3.52 | 3.69 | 0.015 | 0.0016 | 0.0033 | 0.035 | — | — | — | — | — | — | — |
| J | 0.136 | 0.35 | 2.12 | 0.019 | 0.0019 | 0.0032 | 0.038 | — | — | — | — | — | — | — |
| K | 0.142 | 0.38 | 4.12 | 0.010 | 0.0006 | 0.0024 | 0.003 | — | — | — | — | — | — | — |

TABLE 1-continued

| | | | | | | | | | | | | | | |
|---|---|---|---|---|---|---|---|---|---|---|---|---|---|---|
| L | 0.152 | 0.13 | 4.64 | 0.012 | 0.0007 | 0.0040 | 1.100 | — | — | — | — | — | — | — |
| M | 0.154 | 0.52 | 5.09 | 0.008 | 0.0007 | 0.0033 | 0.036 | 0.042 | — | — | — | — | — | — |
| N | 0.163 | 0.28 | 2.94 | 0.018 | 0.0012 | 0.0032 | 0.042 | — | 0.038 | — | — | — | — | — |
| O | 0.134 | 1.28 | 3.67 | 0.012 | 0.0024 | 0.0034 | 0.041 | — | — | 0.029 | — | — | — | — |
| P | 0.179 | 0.78 | 5.03 | 0.013 | 0.0014 | 0.0038 | 0.045 | — | — | — | 0.019 | — | — | — |
| Q | 0.102 | 1.05 | 4.03 | 0.031 | 0.0018 | 0.0049 | 0.032 | 0.052 | — | — | — | 0.0015 | — | — |
| R | 0.108 | 1.22 | 3.69 | 0.022 | 0.0025 | 0.0035 | 0.031 | — | — | — | — | — | 0.550 | — |
| S | 0.135 | 0.46 | 4.45 | 0.016 | 0.0017 | 0.0021 | 0.045 | — | — | — | — | — | — | 0.236 |
| T | 0.156 | 0.48 | 5.23 | 0.014 | 0.0021 | 0.0052 | 0.033 | — | — | — | — | — | — | — |
| U | 0.207 | 0.07 | 3.45 | 0.012 | 0.0030 | 0.0025 | 0.027 | — | — | — | — | — | — | — |
| V | 0.089 | 0.66 | 5.58 | 0.009 | 0.0021 | 0.0043 | 0.035 | — | — | — | — | — | — | — |
| W | 0.133 | 0.29 | 4.59 | 0.018 | 0.0015 | 0.0065 | 0.044 | — | — | — | — | — | — | — |
| X | 0.161 | 0.38 | 5.13 | 0.015 | 0.0012 | 0.0042 | 0.036 | — | — | — | — | — | — | — |
| Y | 0.141 | 0.29 | 4.73 | 0.015 | 0.0014 | 0.0028 | 0.033 | — | 0.042 | — | — | — | — | — |
| Z | 0.120 | 0.59 | 5.39 | 0.021 | 0.0012 | 0.0048 | 0.050 | — | 0.038 | — | — | — | — | — |
| AA | 0.114 | 0.34 | 4.19 | 0.010 | 0.0015 | 0.0041 | 0.038 | — | — | — | — | — | — | — |
| AB | 0.146 | 0.71 | 5.31 | 0.032 | 0.0032 | 0.0041 | 0.035 | — | — | — | — | — | — | — |
| AC | 0.168 | 0.52 | 4.35 | 0.012 | 0.0022 | 0.0034 | 0.031 | — | — | — | — | — | — | — |
| AD | 0.182 | 0.15 | 5.56 | 0.013 | 0.0015 | 0.0032 | 0.052 | — | — | — | — | — | — | — |
| AE | 0.105 | 0.15 | 6.15 | 0.015 | 0.0015 | 0.0025 | 0.035 | — | — | — | — | — | — | — |

| Steel | Chemical composition (mass %) | | | | | | | | | $Ac_1$ transformation temperature | |
|---|---|---|---|---|---|---|---|---|---|---|---|
| type | Mo | Cu | Sn | Sb | Ta | Ca | Mg | Zr | REM | (° C.) | Notes |
| A | — | — | — | — | — | — | — | — | — | 639 | Invention steel |
| B | — | — | — | — | — | — | — | — | — | 608 | Invention steel |
| C | — | — | — | — | — | — | — | — | — | 649 | Invention steel |
| D | — | — | — | — | — | — | — | — | — | 630 | Invention steel |
| E | — | — | — | — | — | — | — | — | — | 603 | Invention steel |
| F | — | — | — | — | — | — | — | — | — | 632 | Invention steel |
| G | — | — | — | — | — | — | — | — | — | 603 | Invention steel |
| H | — | — | — | — | — | — | — | — | — | 623 | Comparative steel |
| I | — | — | — | — | — | — | — | — | — | 684 | Comparative steel |
| J | — | — | — | — | — | — | — | — | — | 693 | Comparative steel |
| K | — | — | — | — | — | — | — | — | — | 638 | Invention steel |
| L | — | — | — | — | — | — | — | — | — | 620 | Invention steel |
| M | — | — | — | — | — | — | — | — | — | 612 | Invention steel |
| N | — | — | — | — | — | — | — | — | — | 669 | Invention steel |
| O | — | — | — | — | — | — | — | — | — | 660 | Invention steel |
| P | — | — | — | — | — | — | — | — | — | 616 | Invention steel |
| Q | — | — | — | — | — | — | — | — | — | 648 | Invention steel |
| R | — | — | — | — | — | — | — | — | — | 651 | Invention steel |
| S | — | — | — | — | — | — | — | — | — | 632 | Invention steel |
| T | 0.148 | — | — | — | — | — | — | — | — | 608 | Invention steel |
| U | — | 0.221 | — | — | — | — | — | — | — | 651 | Invention steel |
| V | — | — | 0.011 | — | — | — | — | — | — | 601 | Invention steel |
| W | — | — | — | 0.008 | — | — | — | — | — | 624 | Invention steel |
| X | — | — | — | — | 0.010 | — | — | — | — | 609 | Invention steel |
| Y | — | — | 0.009 | — | — | — | — | — | — | 619 | Invention steel |
| Z | — | — | — | — | 0.008 | — | — | — | — | 605 | Invention steel |
| AA | — | — | — | — | — | 0.0026 | — | — | — | 636 | Invention steel |
| AB | — | — | — | — | — | — | 0.0025 | — | — | 608 | Invention steel |
| AC | — | — | — | — | — | — | — | 0.0024 | — | 632 | Invention steel |
| AD | — | — | — | — | — | — | — | — | 0.0024 | 594 | Invention steel |
| AE | — | — | — | — | — | — | — | — | — | 579 | Comparative steel |

The underline indicates that the value or steel type is outside the scope of the present invention.
The symbol "—" indicates that the content is at a level similar to that of incidental impurities.

TABLE 2-1

| | | Finish rolling | | Annealing process for hot rolled steel sheet | | Average cooling rate over range of 550° C. to 400° C. after heat | Cold rolling | Average heating rate over temperature range of 400° C. to $Ac_1$ |
|---|---|---|---|---|---|---|---|---|
| No. | Steel type | delivery temperature (° C.) | Coiling temperature (° C.) | Annealing temperature (° C.) | Holding time (s) | treatment of hot rolled steel sheet (° C./h) | reduction ratio (%) | transformation temperature (° C./s) |
| 1 | A | 920 | 490 | 690 | 80000 | 100 | 60.0 | 15 |
| 2 | A | 850 | 600 | 700 | 60000 | 70 | 56.3 | 14 |
| 3 | A | 830 | 620 | 720 | 50000 | 110 | 55.6 | 13 |
| 4 | A | 880 | 570 | 690 | 80000 | 60 | 60.0 | 17 |
| 5 | A | 900 | 510 | 690 | 190000 | 40 | 66.7 | 19 |
| 6 | A | 900 | 550 | 710 | 90000 | 110 | 61.1 | 22 |

TABLE 2-1-continued

| | | | | | | | | |
|---|---|---|---|---|---|---|---|---|
| 7 | A | 870 | 590 | 690 | 120000 | 140 | 55.6 | 13 |
| 8 | A | 900 | 530 | 730 | 90000 | 80 | 66.7 | 20 |
| 9 | A | 850 | 610 | 690 | 150000 | 70 | 55.6 | 14 |
| 10 | A | 900 | 540 | 700 | 70000 | 70 | 61.1 | 12 |
| 11 | A | 880 | 500 | 710 | 60000 | 60 | 64.7 | 13 |
| 12 | A | 940 | 570 | 680 | 70000 | 80 | 61.1 | 15 |
| 13 | A | 910 | 600 | 690 | 100000 | 100 | 66.7 | 14 |
| 14 | A | 910 | 460 | 720 | 80000 | 70 | 70.6 | 13 |
| 15 | A | 920 | 530 | 730 | 140000 | 50 | 64.7 | 17 |
| 16 | A | 870 | 580 | 700 | 80000 | 40 | 66.7 | 19 |
| 17 | A | 860 | 550 | 670 | 120000 | 70 | 61.1 | 16 |
| 18 | A | 920 | 600 | 690 | 80000 | 90 | 61.1 | 21 |
| 19 | A | 900 | 500 | 550 | 60000 | 110 | 56.3 | 15 |
| 20 | A | 850 | 550 | 800 | 50000 | 130 | 55.6 | 16 |
| 21 | A | 930 | 480 | 690 | 15000 | 70 | 60.0 | 17 |
| 22 | A | 870 | 510 | 690 | 120000 | 2 | 66.7 | 19 |
| 23 | A | 830 | 490 | 720 | 80000 | 400 | 61.1 | 14 |
| 24 | A | 910 | 550 | 700 | 100000 | 60 | 55.6 | 3 |
| 25 | A | 890 | 580 | 690 | 180000 | 100 | 64.7 | 13 |
| 26 | A | 860 | 600 | 710 | 150000 | 80 | 66.7 | 17 |
| 27 | A | 840 | 520 | 730 | 90000 | 90 | 56.3 | 19 |
| 28 | B | 900 | 550 | 660 | 150000 | 110 | 58.8 | 22 |
| 29 | B | 860 | 620 | 650 | 80000 | 40 | 56.3 | 13 |
| 30 | C | 900 | 520 | 700 | 90000 | 30 | 60.0 | 20 |
| 31 | D | 910 | 540 | 650 | 100000 | 50 | 58.8 | 14 |

| | First heat treatment of cold rolled steel sheet | | | Second heat treatment of cold rolled steel sheet | | | |
|---|---|---|---|---|---|---|---|
| No. | Heat treatment temperature (° C.) | Heat treatment time (s) | Alloying temperature (° C.) | Heat treatment temperature (° C.) | Heat treatment time (s) | Type* | Notes |
| 1 | 700 | 200 | | | | CR | Invention example |
| 2 | 690 | 180 | | | | CR | Invention example |
| 3 | 730 | 200 | | | | GI | Invention example |
| 4 | 720 | 280 | | | | GI | Invention example |
| 5 | 710 | 160 | | 110 | 40000 | GI | Invention example |
| 6 | 690 | 170 | | 140 | 50000 | GI | Invention example |
| 7 | 700 | 250 | 500 | | | GA | Invention example |
| 8 | 690 | 210 | 490 | | | GA | Invention example |
| 9 | 720 | 160 | 510 | 100 | 80000 | GA | Invention example |
| 10 | 700 | 220 | 500 | 120 | 50000 | GA | Invention example |
| 11 | 690 | 190 | | | | Al | Invention example |
| 12 | 720 | 250 | | | | Al | Invention example |
| 13 | 710 | 240 | | 90 | 100000 | Al | Invention example |
| 14 | 690 | 220 | | 120 | 60000 | Al | Invention example |
| 15 | 700 | 120 | | | | EG | Invention example |
| 16 | 700 | 150 | | | | EG | Invention example |
| 17 | 700 | 180 | | 110 | 80000 | EG | Invention example |
| 18 | 690 | 150 | | 80 | 120000 | EG | Invention example |
| 19 | 700 | 180 | | | | CR | Comparative example |
| 20 | 730 | 200 | 510 | | | GA | Comparative example |
| 21 | 690 | 250 | | | | GI | Comparative example |
| 22 | 710 | 150 | 490 | | | GA | Comparative example |
| 23 | 720 | 300 | | 90 | 80000 | CR | Comparative example |
| 24 | 690 | 500 | | | | EG | Comparative example |
| 25 | 530 | 200 | 500 | 110 | 60000 | GA | Comparative example |
| 26 | 920 | 100 | | | | CR | Comparative example |
| 27 | 710 | 5 | 530 | | | GA | Comparative example |
| 28 | 670 | 160 | | | | CR | Invention example |
| 29 | 690 | 180 | 510 | 90 | 70000 | GA | Invention example |
| 30 | 720 | 160 | | | | CR | Invention example |
| 31 | 690 | 220 | 520 | 100 | 60000 | GA | Invention example |

The underline indicates that the value or steel type is outside the scope of the present invention.

*CR: cold rolled steel sheet, GI: hot-dip galvanized steel sheet (no alloying process for zinc coating), GA: hot-dip galvannealed steel sheet, Al: hot-dip aluminum coated steel sheet, EG: electrogalvanized steel sheet

TABLE 2-2

| No. | Steel type | Finish rolling: delivery temperature (° C.) | Finish rolling: Coiling temperature (° C.) | Annealing process for hot rolled steel sheet: Annealing temperature (° C.) | Annealing process for hot rolled steel sheet: Holding time (s) | Average cooling rate over range of 550° C. to 400° C. after heat treatment of hot rolled steel sheet (° C./h) | Cold rolling reduction ratio (%) | Average heating rate over temperature range of 400° C. to $Ac_1$ transformation temperature (° C./s) |
|---|---|---|---|---|---|---|---|---|
| 32 | E | 920 | 530 | 630 | 50000 | 20 | 58.8 | 12 |
| 33 | F | 900 | 570 | 660 | 60000 | 90 | 57.1 | 13 |
| 34 | G | 880 | 580 | 640 | 80000 | 30 | 50.0 | 15 |
| 35 | H | 870 | 600 | 670 | 130000 | 60 | 46.2 | 14 |
| 36 | I | 860 | 530 | 710 | 190000 | 100 | 62.5 | 13 |
| 37 | J | 900 | 500 | 730 | 110000 | 110 | 58.8 | 17 |
| 38 | K | 910 | 520 | 680 | 90000 | 130 | 61.1 | 19 |
| 39 | L | 890 | 500 | 650 | 140000 | 90 | 58.8 | 22 |
| 40 | M | 880 | 530 | 640 | 80000 | 40 | 56.3 | 13 |
| 41 | M | 870 | 580 | 630 | 110000 | 80 | 57.1 | 20 |
| 42 | M | 850 | 600 | 650 | 80000 | 120 | 50.0 | 14 |
| 43 | M | 900 | 610 | 640 | 140000 | 150 | 46.2 | 12 |
| 44 | M | 920 | 630 | 650 | 150000 | 80 | 64.7 | 13 |
| 45 | N | 860 | 620 | 700 | 90000 | 120 | 62.5 | 15 |
| 46 | O | 870 | 560 | 690 | 60000 | 60 | 64.7 | 14 |
| 47 | P | 830 | 570 | 650 | 80000 | 60 | 50.0 | 13 |
| 48 | Q | 850 | 530 | 680 | 140000 | 50 | 53.8 | 17 |
| 49 | R | 930 | 540 | 690 | 200000 | 50 | 52.9 | 19 |
| 50 | S | 900 | 550 | 680 | 90000 | 40 | 47.1 | 19 |
| 51 | T | 920 | 560 | 640 | 90000 | 20 | 55.6 | 15 |
| 52 | U | 890 | 520 | 690 | 50000 | 40 | 56.3 | 16 |
| 53 | V | 880 | 500 | 650 | 80000 | 60 | 70.6 | 13 |
| 54 | W | 870 | 590 | 700 | 110000 | 50 | 64.7 | 16 |
| 55 | X | 880 | 610 | 630 | 70000 | 60 | 50.0 | 15 |
| 56 | Y | 890 | 620 | 670 | 80000 | 30 | 56.3 | 13 |
| 57 | Z | 900 | 580 | 640 | 90000 | 70 | 52.6 | 15 |
| 58 | AA | 920 | 620 | 690 | 130000 | 50 | 28.1 | 16 |
| 59 | AB | 860 | 560 | 650 | 180000 | 60 | 50.0 | 17 |
| 60 | AC | 850 | 570 | 680 | 50000 | 30 | 56.3 | 19 |
| 61 | AD | 810 | 530 | 630 | 80000 | 120 | 57.1 | 17 |
| 62 | AE | 860 | 480 | 650 | 140000 | 60 | 58.8 | 15 |

| No. | First heat treatment of cold rolled steel sheet: Heat treatment temperature (° C.) | First heat treatment of cold rolled steel sheet: Heat treatment time (s) | Alloying temperature (° C.) | Second heat treatment of cold rolled steel sheet: Heat treatment temperature (° C.) | Second heat treatment of cold rolled steel sheet: Heat treatment time (s) | Type* | Notes |
|---|---|---|---|---|---|---|---|
| 32 | 670 | 210 | 500 | | | GA | Invention example |
| 33 | 700 | 300 | | 130 | 70000 | GI | Invention example |
| 34 | 660 | 180 | | | | CR | Invention example |
| 35 | 690 | 280 | | | | CR | Comparative example |
| 36 | 740 | 220 | | 140 | 50000 | CR | Comparative example |
| 37 | 750 | 180 | 510 | | | GA | Comparative example |
| 38 | 710 | 150 | | | | CR | Invention example |
| 39 | 690 | 280 | 500 | 120 | 90000 | GA | Invention example |
| 40 | 670 | 200 | | | | CR | Invention example |
| 41 | 680 | 170 | | 100 | 70000 | GI | Invention example |
| 42 | 690 | 210 | 510 | 130 | 50000 | GA | Invention example |
| 43 | 670 | 230 | | 110 | 80000 | Al | Invention example |
| 44 | 680 | 230 | | 90 | 100000 | EG | Invention example |
| 45 | 720 | 360 | 500 | 180 | 110000 | GA | Invention example |
| 46 | 720 | 270 | | | | CR | Invention example |
| 47 | 690 | 250 | | | | CR | Invention example |
| 48 | 700 | 180 | 540 | 180 | 50000 | GA | Invention example |
| 49 | 710 | 200 | 550 | | | GA | Invention example |
| 50 | 680 | 170 | 520 | | | GA | Invention example |
| 51 | 670 | 140 | 510 | 210 | 30000 | GA | Invention example |
| 52 | 710 | 150 | | | | Al | Invention example |
| 53 | 670 | 80 | 520 | | | GA | Invention example |
| 54 | 690 | 110 | | 90 | 120000 | GI | Invention example |
| 55 | 690 | 140 | | | | EG | Invention example |
| 56 | 680 | 200 | | | | CR | Invention example |
| 57 | 660 | 180 | 490 | | | GA | Invention example |
| 58 | 700 | 200 | | 230 | 30000 | Al | Invention example |
| 59 | 660 | 450 | 510 | 150 | 50000 | GA | Invention example |
| 60 | 690 | 150 | | | | CR | Invention example |

TABLE 2-2-continued

| | | | | | | | |
|---|---|---|---|---|---|---|---|
| 61 | 650 | 180 | 500 | 110 | 70000 | GA | Invention example |
| 62 | 700 | 200 | | 180 | 70000 | CR | Comparative example |

The underline indicates that the value or steel type is outside the scope of the present invention.

*CR: cold rolled steel sheet, GI: hot-dip galvanized steel sheet (no alloying process for zinc coating), GA: hot-dip galvannealed steel sheet, Al: hot-dip aluminum coated steel sheet, EG: electrogalvanized steel sheet

TABLE 3-1

| No. | Steel type | Sheet thickness (mm) | Area fraction of F (%) | Area fraction of M (%) | Volume fraction of RA (%) | Average grain size of F (μm) | Average grain size of RA (μm) | Mn content of RA (mass %) | Mn content of RA/Mn content of steel | Ratio of retained austenite grains having aspect ratio of 3.0 or greater (%) | Ratio of retained austenite grains having aspect ratio of less than 2.0 (%) | Amount of diffusible hydrogen in steel (mass-ppm) | Vγa/Vγb |
|---|---|---|---|---|---|---|---|---|---|---|---|---|---|
| 1 | A | 1.2 | 72.7 | 8.9 | 17.2 | 3.1 | 0.6 | 8.02 | 1.97 | 49 | 38 | 0.06 | 0.65 |
| 2 | A | 1.4 | 77.3 | 9.2 | 12.8 | 3.3 | 0.5 | 8.37 | 2.05 | 38 | 48 | 0.05 | 0.64 |
| 3 | A | 1.6 | 74.1 | 11.2 | 13.2 | 3.2 | 0.5 | 8.08 | 1.98 | 52 | 35 | 0.56 | 0.61 |
| 4 | A | 1.6 | 76.4 | 8.5 | 13.7 | 2.2 | 0.7 | 8.45 | 2.07 | 28 | 68 | 0.58 | 0.65 |
| 5 | A | 1.2 | 74.3 | 6.2 | 16.3 | 2.9 | 0.8 | 8.01 | 1.96 | 72 | 25 | 0.02 | 0.66 |
| 6 | A | 1.4 | 74.9 | 5.3 | 16.1 | 3.2 | 0.5 | 8.24 | 2.02 | 47 | 42 | 0.01 | 0.62 |
| 7 | A | 1.6 | 74.6 | 11.8 | 13.1 | 2.8 | 0.7 | 8.05 | 1.97 | 39 | 53 | 0.57 | 0.61 |
| 8 | A | 1.2 | 77.5 | 6.4 | 15.7 | 3.7 | 0.8 | 8.12 | 1.99 | 22 | 69 | 0.57 | 0.61 |
| 9 | A | 1.6 | 72.2 | 6.7 | 16.4 | 2.8 | 0.5 | 8.02 | 1.97 | 36 | 56 | 0.02 | 0.64 |
| 10 | A | 1.0 | 74.4 | 5.1 | 16.5 | 2.2 | 0.6 | 8.68 | 2.13 | 43 | 41 | 0.01 | 0.67 |
| 11 | A | 1.2 | 69.3 | 10.1 | 18.9 | 2.0 | 0.4 | 8.97 | 2.20 | 58 | 36 | 0.52 | 0.70 |
| 12 | A | 1.4 | 71.5 | 9.4 | 17.8 | 2.2 | 0.7 | 9.12 | 2.24 | 63 | 24 | 0.53 | 0.71 |
| 13 | A | 1.6 | 70.3 | 10.3 | 15.1 | 2.3 | 0.8 | 9.02 | 2.21 | 71 | 25 | 0.21 | 0.70 |
| 14 | A | 1.2 | 73.9 | 9.2 | 15.8 | 2.1 | 0.5 | 8.85 | 2.17 | 23 | 67 | 0.25 | 0.69 |
| 15 | A | 1.4 | 72.8 | 5.4 | 20.4 | 2.2 | 0.7 | 9.16 | 2.25 | 40 | 51 | 0.53 | 0.72 |
| 16 | A | 1.4 | 75.6 | 4.8 | 19.2 | 2.0 | 0.6 | 8.74 | 2.14 | 51 | 43 | 0.52 | 0.67 |
| 17 | A | 1.4 | 69.8 | 10.5 | 15.9 | 2.2 | 0.4 | 9.22 | 2.26 | 62 | 34 | 0.31 | 0.72 |
| 18 | A | 1.4 | 73.1 | 7.6 | 16.5 | 2.8 | 0.3 | 8.91 | 2.18 | 47 | 42 | 0.22 | 0.69 |
| 19 | A | 1.4 | 72.3 | 12.1 | 10.1 | 4.4 | 3.1 | 5.32 | 1.30 | 17 | 80 | 0.06 | 0.26 |
| 20 | A | 1.6 | 73.1 | 14.2 | 9.2 | 3.3 | 2.7 | 5.06 | 1.24 | 72 | 18 | 0.59 | 0.32 |
| 21 | A | 1.6 | 75.9 | 8.6 | 10.5 | 2.6 | 3.0 | 5.42 | 1.33 | 23 | 72 | 0.61 | 0.23 |
| 22 | A | 1.2 | 77.2 | 9.6 | 8.4 | 6.3 | 4.2 | 6.70 | 1.64 | 39 | 51 | 0.64 | 0.45 |
| 23 | A | 1.4 | 74.5 | 6.9 | 14.0 | 5.9 | 2.8 | 6.98 | 1.71 | 4 | 78 | 0.02 | 0.52 |
| 24 | A | 1.6 | 78.4 | 4.7 | 12.8 | 7.2 | 1.6 | 7.04 | 1.73 | 20 | 75 | 0.56 | 0.80 |
| 25 | A | 1.2 | 85.6 | 2.8 | 3.8 | 4.8 | 0.4 | 9.12 | 2.24 | 78 | 11 | 0.07 | 0.17 |
| 26 | A | 1.2 | 41.9 | 39.2 | 4.5 | 6.8 | 3.4 | 9.11 | 2.23 | 38 | 47 | 0.05 | 0.82 |
| 27 | A | 1.4 | 86.9 | 2.5 | 3.6 | 4.9 | 0.3 | 9.08 | 2.23 | 42 | 44 | 0.54 | 0.74 |
| 28 | B | 1.4 | 70.7 | 6.2 | 20.7 | 2.1 | 0.7 | 8.92 | 1.76 | 39 | 52 | 0.06 | 0.69 |
| 29 | B | 1.4 | 71.8 | 5.1 | 18.9 | 2.8 | 0.6 | 9.20 | 1.81 | 65 | 31 | 0.01 | 0.72 |
| 30 | C | 1.2 | 64.8 | 13.4 | 20.8 | 2.6 | 0.6 | 9.30 | 2.49 | 43 | 41 | 0.06 | 0.73 |
| 31 | D | 1.4 | 65.8 | 10.2 | 19.1 | 2.5 | 0.4 | 9.28 | 2.15 | 29 | 67 | 0.04 | 0.73 |

| No. | Remaining constituents | TS (MPa) | EL (%) | YP-EL (%) | U.EL (%) | Cracking threshold spacer thickness in contact bending test after U-bending (mm) | Handkerchief bending test R/t | V-bending-90° rotation U-bending test R/t | Form of deformation in bending crush | Form of deformation in axial crush | Type* | Notes |
|---|---|---|---|---|---|---|---|---|---|---|---|---|
| 1 | θ | 1012 | 28.9 | 4.1 | 23.9 | 3.5 | 3.0 | 3.5 | ○ | ○ | CR | Invention example |
| 2 | θ | 997 | 32.7 | 3.2 | 27.7 | 3.0 | 2.5 | 3.0 | ○ | ○ | CR | Invention example |
| 3 | θ | 1009 | 29.8 | 4.8 | 24.8 | 5.0 | 4.0 | 4.5 | ○ | ○ | GI | Invention example |
| 4 | θ | 1020 | 33.8 | 3.1 | 28.8 | 5.0 | 4.0 | 4.0 | ○ | ○ | GI | Invention example |
| 5 | TM, TB, θ | 989 | 30.9 | 4.5 | 25.9 | 3.5 | 3.5 | 4.0 | ○ | ○ | GI | Invention example |
| 6 | TM, TB, θ | 996 | 35.1 | 2.8 | 30.1 | 3.0 | 3.5 | 3.0 | ○ | ○ | GI | Invention example |
| 7 | θ | 989 | 30.4 | 4.0 | 25.4 | 5.0 | 4.5 | 5.0 | ○ | ○ | GA | Invention example |
| 8 | θ | 1001 | 33.9 | 3.1 | 28.9 | 5.0 | 4.0 | 4.0 | ○ | ○ | GA | Invention example |

TABLE 3-1-continued

| | | | | | | | | | | | | |
|---|---|---|---|---|---|---|---|---|---|---|---|---|
| 9 | TM, TB, θ | 994 | 30.8 | 4.3 | 25.8 | 3.5 | 3.5 | 3.5 | ○ | ○ | GA | Invention example |
| 10 | TM, TB, θ | 1006 | 35.1 | 2.8 | 30.1 | 3.0 | 3.0 | 4.5 | ○ | ○ | GA | Invention example |
| 11 | θ | 1002 | 29.8 | 4.5 | 24.8 | 4.5 | 4.0 | 4.0 | ○ | ○ | Al | Invention example |
| 12 | θ | 996 | 33.9 | 2.8 | 28.9 | 4.5 | 4.0 | 4.5 | ○ | ○ | Al | Invention example |
| 13 | TM, TB, θ | 1018 | 28.5 | 4.8 | 23.5 | 3.5 | 3.5 | 3.0 | ○ | ○ | Al | Invention example |
| 14 | TM, TB, θ | 1012 | 32.8 | 3.1 | 27.8 | 4.0 | 2.5 | 4.0 | ○ | ○ | Al | Invention example |
| 15 | θ | 998 | 29.5 | 4.3 | 24.5 | 4.5 | 4.0 | 4.0 | ○ | ○ | EG | Invention example |
| 16 | θ | 992 | 32.0 | 2.8 | 27.0 | 4.5 | 4.0 | 4.5 | ○ | ○ | EG | Invention example |
| 17 | TM, TB, θ | 988 | 29.5 | 4.1 | 24.5 | 3.5 | 4.0 | 3.0 | ○ | ○ | EG | Invention example |
| 18 | θ | 1002 | 32.1 | 3.2 | 27.1 | 3.0 | 2.5 | 4.0 | ○ | ○ | EG | Invention example |
| 19 | θ | 1024 | 16.3 | 2.5 | 12.3 | 7.5 | 6.5 | 6.5 | X | X | CR | Comparative example |
| 20 | θ | 1085 | 15.5 | 2.1 | 11.9 | 6.0 | 6.5 | 7.0 | X | X | GA | Comparative example |
| 21 | θ | 994 | 19.2 | 2.8 | 14.2 | 6.5 | 6.0 | 6.0 | X | X | GI | Comparative example |
| 22 | θ | 1008 | 12.2 | 0.5 | 10.1 | 7.0 | 7.5 | 7.5 | X | X | GA | Comparative example |
| 23 | TM, TB, θ | 1010 | 14.7 | 0.2 | 13.2 | 6.0 | 6.5 | 6.5 | X | X | CR | Comparative example |
| 24 | θ | 1021 | 26.2 | 0.5 | 21.3 | 6.0 | 6.5 | 6.5 | X | X | EG | Comparative example |
| 25 | TM, TB, θ | 687 | 26.1 | 2.4 | 20.2 | 4.5 | 4.0 | 4.5 | X | X | GA | Comparative example |
| 26 | θ | 1289 | 11.1 | 0.2 | 9.3 | 7.0 | 7.5 | 7.0 | X | X | CR | Comparative example |
| 27 | θ | 708 | 23.9 | 2.4 | 19.1 | 5.0 | 5.0 | 4.5 | ○ | ○ | GA | Comparative example |
| 28 | θ | 1018 | 29.5 | 2.8 | 24.5 | 3.5 | 3.0 | 3.5 | ○ | ○ | CR | Invention example |
| 29 | TM, TB, θ | 1012 | 32.0 | 4.0 | 27.0 | 4.0 | 2.5 | 3.0 | ○ | ○ | GA | Invention example |
| 30 | θ | 998 | 29.5 | 2.8 | 24.5 | 3.5 | 3.0 | 3.0 | ○ | ○ | CR | Invention example |
| 31 | TM, TB, θ | 996 | 35.1 | 4.3 | 30.1 | 4.0 | 4.0 | 4.5 | ○ | ○ | GA | Invention example |

The underline indicates that the value or steel type is outside the scope of the present invention.

F: ferrite, M: martensite, RA: retained austenite, TM: tempered martensite, TB: tempered bainite, θ: carbides such as cementite

*CR: cold rolled steel sheet, GI: hot-dip galvanized steel sheet (no alloying process for zinc coating), GA: hot-dip galvannealed steel sheet, Al: hot-dip aluminum coated steel sheet, EG: electrogalvanized steel sheet

TABLE 3-2

| No. | Steel type | Sheet thickness (mm) | Area fraction of F (%) | Area fraction of M (%) | Volume fraction of RA (%) | Average grain size of F (μm) | Average grain size of RA (μm) | Mn content of RA (mass %) | Mn content of RA/Mn content of steel | Ratio of retained austenite grains having aspect ratio of 3.0 or greater (%) | Ratio of retained austenite grains having aspect ratio of less than 2.0 (%) | Amount of diffusible hydrogen in steel (mass-ppm) | Vγa/Vγb |
|---|---|---|---|---|---|---|---|---|---|---|---|---|---|
| 32 | E | 1.6 | 63.3 | 13.6 | 21.2 | 2.8 | 0.5 | 9.30 | 1.66 | 64 | 30 | 0.53 | 0.73 |
| 33 | F | 1.6 | 64.2 | 11.8 | 18.9 | 2.9 | 0.4 | 9.28 | 1.92 | 54 | 34 | 0.04 | 0.73 |
| 34 | G | 1.2 | 64.5 | 10.2 | 21.5 | 2.6 | 0.6 | 9.10 | 1.74 | 32 | 59 | 0.05 | 0.71 |
| 35 | H | 1.4 | 78.9 | 2.3 | 2.1 | 4.5 | 1.2 | 9.23 | 1.91 | 72 | 12 | 0.05 | 0.18 |
| 36 | I | 1.6 | 65.2 | 12.5 | 18.7 | 2.9 | 1.0 | 9.08 | 2.46 | 38 | 54 | 0.01 | 0.22 |
| 37 | J | 1.2 | 66.0 | 24.8 | 8.2 | 4.6 | 0.7 | 9.22 | 4.35 | 32 | 58 | 0.57 | 0.55 |
| 38 | K | 1.6 | 69.1 | 11.1 | 17.9 | 1.5 | 0.4 | 9.14 | 2.22 | 31 | 53 | 0.06 | 0.71 |
| 39 | L | 1.0 | 67.4 | 9.2 | 19.6 | 1.9 | 0.8 | 9.09 | 1.96 | 49 | 36 | 0.01 | 0.71 |
| 40 | M | 1.4 | 72.7 | 8.9 | 17.2 | 2.4 | 0.7 | 8.89 | 1.75 | 41 | 52 | 0.05 | 0.69 |
| 41 | M | 1.4 | 67.5 | 10.2 | 18.6 | 2.5 | 0.8 | 8.94 | 1.76 | 28 | 70 | 0.31 | 0.69 |
| 42 | M | 1.2 | 68.7 | 8.9 | 17.2 | 2.2 | 0.6 | 7.80 | 1.53 | 34 | 55 | 0.02 | 0.55 |
| 43 | M | 1.4 | 70.9 | 10.7 | 13.2 | 2.7 | 0.8 | 7.97 | 1.57 | 52 | 38 | 0.04 | 0.60 |
| 44 | M | 1.6 | 71.7 | 10.8 | 13.9 | 2.6 | 0.7 | 8.27 | 1.62 | 24 | 68 | 0.21 | 0.63 |
| 45 | N | 1.8 | 69.7 | 6.7 | 19.7 | 2.5 | 0.5 | 8.36 | 2.84 | 49 | 46 | 0.01 | 0.64 |

TABLE 3-2-continued

| | | | | | | | | | | | | | |
|---|---|---|---|---|---|---|---|---|---|---|---|---|---|
| 46 | O | 1.4 | 74.9 | 10.7 | 13.2 | 2.5 | 0.6 | 9.01 | 2.45 | 36 | 53 | 0.09 | 0.70 |
| 47 | P | 1.2 | 71.8 | 7.4 | 19.2 | 2.8 | 0.8 | 8.01 | 1.59 | 62 | 35 | 0.05 | 0.60 |
| 48 | Q | 1.4 | 68.2 | 10.2 | 17.6 | 2.9 | 1.0 | 6.29 | 1.56 | 28 | 68 | 0.29 | 0.64 |
| 49 | R | 1.4 | 70.6 | 8.7 | 18.9 | 2.8 | 0.8 | 7.91 | 2.14 | 22 | 71 | 0.51 | 0.59 |
| 50 | S | 1.2 | 71.2 | 7.3 | 19.7 | 1.9 | 0.7 | 9.16 | 2.06 | 25 | 59 | 0.52 | 0.72 |
| 51 | T | 1.2 | 71.2 | 10.2 | 17.6 | 2.2 | 0.7 | 8.04 | 1.54 | 34 | 59 | 0.04 | 0.60 |
| 52 | U | 1.4 | 70.7 | 10.5 | 18.2 | 2.5 | 0.4 | 8.58 | 2.49 | 42 | 50 | 0.55 | 0.66 |
| 53 | V | 1.2 | 71.1 | 6.2 | 21.5 | 2.8 | 0.6 | 8.73 | 1.56 | 32 | 55 | 0.53 | 0.60 |
| 54 | W | 1.6 | 70.2 | 9.8 | 15.8 | 2.3 | 0.8 | 8.47 | 1.85 | 22 | 69 | 0.06 | 0.65 |
| 55 | X | 1.8 | 69.1 | 10.6 | 19.2 | 2.2 | 0.9 | 8.57 | 1.67 | 28 | 70 | 0.56 | 0.66 |
| 56 | Y | 1.6 | 71.4 | 8.9 | 19.5 | 2.9 | 0.7 | 8.38 | 1.77 | 34 | 53 | 0.05 | 0.64 |
| 57 | Z | 1.4 | 72.2 | 10.1 | 16.4 | 2.2 | 0.6 | 8.42 | 1.56 | 54 | 41 | 0.56 | 0.64 |
| 58 | AA | 1.0 | 73.1 | 7.7 | 14.9 | 2.6 | 0.5 | 8.66 | 2.07 | 36 | 56 | 0.25 | 0.67 |
| 59 | AB | 1.2 | 70.2 | 5.7 | 21.2 | 2.9 | 0.4 | 8.81 | 1.66 | 30 | 64 | 0.02 | 0.68 |
| 60 | AC | 1.6 | 70.6 | 10.3 | 17.8 | 3.1 | 0.7 | 8.71 | 2.00 | 27 | 69 | 0.05 | 0.67 |
| 61 | AD | 1.4 | 71.4 | 6.7 | 18.1 | 3.2 | 0.4 | 8.53 | 1.53 | 42 | 49 | 0.05 | 0.65 |
| 62 | AE | 1.6 | 55.2 | 22.5 | 18.7 | 2.2 | 0.7 | 9.58 | 1.56 | 35 | 50 | 0.02 | 0.18 |

| No. | Remaining constituents | TS (MPa) | EL (%) | YP-EL (%) | U.EL (%) | Cracking threshold spacer thickness in contact bending test after U-bending (mm) | Handkerchief bending test R/t | V-bending-90° rotation U-bending test R/t | Form of deformation in bending crush | Form of deformation in axial crush | Type* | Notes |
|---|---|---|---|---|---|---|---|---|---|---|---|---|
| 32 | θ | 989 | 30.4 | 4.5 | 25.4 | 4.5 | 4.0 | 4.0 | ○ | ○ | GA | Invention example |
| 33 | TM, TB, θ | 989 | 30.9 | 3.1 | 25.9 | 4.0 | 4.0 | 4.5 | ○ | ○ | GI | Invention example |
| 34 | θ | 996 | 35.1 | 4.5 | 30.1 | 3.5 | 3.0 | 3.5 | ○ | ○ | CR | Invention example |
| 35 | θ | 864 | 20.4 | 2.2 | 15.4 | 7.5 | 6.5 | 7.0 | X | X | CR | Comparative example |
| 36 | TM, TB, θ | 993 | 21.7 | 1.8 | 16.7 | 7.0 | 6.0 | 6.5 | X | X | CR | Comparative example |
| 37 | θ | 995 | 18.6 | 2.0 | 13.6 | 7.5 | 7.0 | 7.0 | X | X | GA | Comparative example |
| 38 | θ | 1002 | 29.8 | 4.5 | 24.8 | 3.0 | 3.0 | 3.0 | ○ | ○ | CR | Invention example |
| 39 | TM, TB, θ | 996 | 33.9 | 2.8 | 28.9 | 3.0 | 3.5 | 3.0 | ○ | ○ | GA | Invention example |
| 40 | θ | 996 | 35.1 | 2.8 | 30.1 | 3.0 | 3.5 | 3.5 | ○ | ○ | CR | Invention example |
| 41 | TM, TB, θ | 989 | 30.4 | 4.0 | 25.4 | 3.0 | 2.5 | 3.0 | ○ | ○ | GI | Invention example |
| 42 | TM, TB, θ | 1001 | 33.9 | 3.1 | 28.9 | 4.0 | 2.5 | 2.5 | ○ | ○ | GA | Invention example |
| 43 | TM, TB, θ | 994 | 30.8 | 4.3 | 25.8 | 3.5 | 3.0 | 2.5 | ○ | ○ | AI | Invention example |
| 44 | TM, TB, θ | 989 | 30.9 | 4.5 | 25.9 | 3.5 | 2.5 | 3.0 | ○ | ○ | EG | Invention example |
| 45 | TM, TB,0 | 996 | 35.1 | 2.8 | 30.1 | 4.0 | 4.0 | 4.5 | ○ | ○ | GA | Invention example |
| 46 | θ | 989 | 30.4 | 4.0 | 25.4 | 3.0 | 2.5 | 3.0 | ○ | ○ | CR | Invention example |
| 47 | θ | 1001 | 33.9 | 3.1 | 28.9 | 3.5 | 2.5 | 3.5 | ○ | ○ | CR | Invention example |
| 48 | TM, TB, θ | 994 | 30.8 | 4.3 | 25.8 | 4.0 | 3.0 | 3.0 | ○ | ○ | GA | Invention example |
| 49 | θ | 1006 | 35.1 | 2.8 | 30.1 | 4.5 | 4.0 | 4.5 | ○ | ○ | GA | Invention example |
| 50 | θ | 1002 | 29.8 | 4.5 | 24.8 | 4.5 | 4.0 | 5.0 | ○ | ○ | GA | Invention example |
| 51 | TM, TB, θ | 996 | 33.9 | 2.8 | 28.9 | 3.0 | 3.0 | 3.0 | ○ | ○ | GA | Invention example |
| 52 | θ | 1018 | 28.5 | 4.8 | 23.5 | 5.0 | 4.0 | 4.5 | ○ | ○ | AI | Invention example |
| 53 | θ | 1012 | 32.8 | 3.1 | 27.8 | 4.5 | 4.0 | 4.0 | ○ | ○ | GA | Invention example |
| 54 | TM, TB, θ | 998 | 29.5 | 4.3 | 24.5 | 3.5 | 2.5 | 3.0 | ○ | ○ | GI | Invention example |
| 55 | θ | 1019 | 28.5 | 4.8 | 23.5 | 5.0 | 4.5 | 4.5 | ○ | ○ | EG | Invention example |
| 56 | θ | 1012 | 32.8 | 3.1 | 27.8 | 4.0 | 3.0 | 3.0 | ○ | ○ | CR | Invention example |

TABLE 3-2-continued

| | | | | | | | | | | | | |
|---|---|---|---|---|---|---|---|---|---|---|---|---|
| 57 | θ | 998 | 29.5 | 4.3 | 24.5 | 5.0 | 4.0 | 4.5 | ○ | ○ | GA | Invention example |
| 58 | TM, TB, θ | 1002 | 29.8 | 4.5 | 24.8 | 4.0 | 3.0 | 3.0 | ○ | ○ | AI | Invention example |
| 59 | TM, TB, θ | 996 | 33.9 | 2.8 | 28.9 | 3.5 | 2.5 | 3.5 | ○ | ○ | GA | Invention example |
| 60 | θ | 1018 | 28.5 | 4.8 | 23.5 | 4.0 | 2.5 | 3.0 | ○ | ○ | CR | Invention example |
| 61 | TM, TB, θ | 1012 | 32.8 | 3.1 | 27.8 | 3.0 | 2.5 | 3.0 | ○ | ○ | GA | Invention example |
| 62 | TM, TB, θ | 1025 | 18.5 | 2.2 | 13.5 | 6.5 | 6.5 | 6.5 | X | X | CR | Comparative example |

The underline indicates that the value or steel type is outside the scope of the present invention.

F: ferrite, M: martensite, RA: retained austenite, TM: tempered martensite, TB: tempered bainite, θ: carbides such as cementite

*CR: cold rolled steel sheet, GI: hot-dip galvanized steel sheet (no alloying process for zinc coating), GA: hot-dip galvannealed steel sheet, AI: hot-dip aluminum coated steel sheet, EG: electrogalvanized steel sheet The steel sheets according to aspects of the present invention all had a TS of 980 MPa or greater and also had excellent uniform ductility, bendability, and crush performance. In contrast, in Comparative Examples, one of the properties, namely, TS, EL, YP-EL, U.EL, various types of bendability, and forms of crush, is poor.

The invention claimed is:

1. A high strength steel sheet, the high strength steel sheet having a yield-point elongation (YP-EL) of 1.0% or greater and a tensile strength (TS) of 980 MPa or greater, the high strength steel sheet having a chemical composition containing, in mass %, C: 0.030% or greater and 0.250% or less, Si: 0.01% or greater and 2.00% or less, Mn: 3.10% or greater and 6.00% or less, P: 0.001% or greater and 0.100% or less, S: 0.0001% or greater and 0.0200% or less, N: 0.0005% or greater and 0.0100% or less, and Al: 0.001% or greater and 1.200% or less, with a balance of Fe and incidental impurities, and the high strength steel sheet having the microstructure in which ferrite is present in an area fraction of 30.0% or greater and less than 80.0%, martensite is present in an area fraction of 3.0% or greater and 30.0% or less, retained austenite is present in a volume fraction of 12.0% or greater, the ferrite has an average grain size of 5.0 μm or less, the retained austenite has an average grain size of 2.0 μm or less, a value obtained by dividing a Mn content mass % of the retained austenite by a Mn content mass % of steel is 1.50 or greater, 15% or more of all retained austenite grains in the retained austenite have an aspect ratio of 3.0 or greater, and 15% or more of all the retained austenite grains in the retained austenite have an aspect ratio of less than 2.0, wherein a value obtained by dividing a volume fraction Vγa by a volume fraction Vγb is 0.40 or greater, where the volume fraction Vγa is a volume fraction of retained austenite in a fractured portion of a tensile test specimen after a warm tensile test at 150° C., and the volume fraction Vγb is a volume fraction of retained austenite before the warm tensile test at 150° C.

2. The high strength steel sheet according to claim 1, the high strength steel sheet having a yield-point elongation (YP-EL) of 1.0% or greater and a tensile strength (TS) of 980 MPa or greater, wherein the chemical composition contains, in mass %, at least one element selected from Ti: 0.002% or greater and 0.200% or less, Nb: 0.005% or greater and 0.200% or less, V: 0.005% or greater and 0.500% or less, W: 0.0005% or greater and 0.500% or less, B: 0.0003% or greater and 0.0050% or less, Ni: 0.005% or greater and 1.000% or less, Cr: 0.005% or greater and 1.000% or less, Mo: 0.005% or greater and 1.000% or less, Cu: 0.005% or greater and 1.000% or less, Sn: 0.002% or greater and 0.200% or less, Sb: 0.002% or greater and 0.200% or less, Ta: 0.001% or greater and 0.100% or less, Zr: 0.0005% or greater and 0.0050% or less, Ca: 0.0005% or greater and 0.0050% or less, Mg: 0.0005% or greater and 0.0050% or less, and REM: 0.0005% or greater and 0.0050% or less.

3. The high strength steel sheet according to claim 1, the high strength steel sheet having a yield-point elongation (YP-EL) of 1.0% or greater and a tensile strength (TS) of 980 MPa or greater, wherein the high strength steel sheet has a zinc coated layer on a surface of the steel sheet.

4. The high strength steel sheet according to claim 2, the high strength steel sheet having a yield-point elongation (YP-EL) of 1.0% or greater and a tensile strength (TS) of 980 MPa or greater, wherein the high strength steel sheet has a zinc coated layer on a surface of the steel sheet.

5. An impact absorbing member, the impact absorbing member comprising an impact absorbing portion that absorbs impact energy by undergoing bending crush and deformation, the impact absorbing portion comprising the high strength steel sheet according to claim 1.

6. An impact absorbing member, the impact absorbing member comprising an impact absorbing portion that absorbs impact energy by undergoing bending crush and deformation, the impact absorbing portion comprising the high strength steel sheet according to claim 2.

7. An impact absorbing member, the impact absorbing member comprising an impact absorbing portion that absorbs impact energy by undergoing bending crush and deformation, the impact absorbing portion comprising the high strength steel sheet according to claim 3.

8. An impact absorbing member, the impact absorbing member comprising an impact absorbing portion that absorbs impact energy by undergoing bending crush and deformation, the impact absorbing portion comprising the high strength steel sheet according to claim 4.

9. An impact absorbing member, the impact absorbing member comprising an impact absorbing portion that absorbs impact energy by undergoing axial crush and deformation into a bellows shape, the impact absorbing portion comprising the high strength steel sheet according to claim 1.

10. An impact absorbing member, the impact absorbing member comprising an impact absorbing portion that absorbs impact energy by undergoing axial crush and deformation into a bellows shape, the impact absorbing portion comprising the high strength steel sheet according to claim 2.

11. An impact absorbing member, the impact absorbing member comprising an impact absorbing portion that absorbs impact energy by undergoing axial crush and deformation into a bellows shape, the impact absorbing portion comprising the high strength steel sheet according to claim 3.

12. An impact absorbing member, the impact absorbing member comprising an impact absorbing portion that absorbs impact energy by undergoing axial crush and deformation into a bellows shape, the impact absorbing portion comprising the high strength steel sheet according to claim 4.

13. A method for manufacturing the high strength steel sheet according to claim 1, the method comprising:

performing a pickling process on a hot rolled steel sheet;

holding a resulting steel sheet within a temperature range of an $Ac_1$ transformation temperature or greater and the $Ac_1$ transformation temperature+150° C. or less for a period of more than 21,600 seconds and 259,200 seconds or less, subsequently cooling the resulting steel sheet at an average cooling rate of 5° C./hour or greater and 200° C./hour or less through a temperature range of 550° C. to 400° C., subsequently cold rolling the resulting steel sheet, heating a resulting cold rolled steel sheet at an average heating rate of 8° C./second or greater and 50° C./second or less through a temperature range of 400° C. to the $Ac_1$ transformation temperature, and holding the resulting cold rolled steel sheet within a temperature range of the $Ac_1$ transformation temperature or greater and the $Ac_1$ transformation temperature+150° C. or less for a period of 20 seconds or more and 3,600 seconds or less.

14. A method for manufacturing the high strength steel sheet according to claim 2, the method comprising:

performing a pickling process on a hot rolled steel sheet;

holding a resulting steel sheet within a temperature range of an $Ac_1$ transformation temperature or greater and the $Ac_1$ transformation temperature+150° C. or less for a period of more than 21,600 seconds and 259,200 seconds or less, subsequently cooling the resulting steel sheet at an average cooling rate of 5° C./hour or greater and 200° C./hour or less through a temperature range of 550° C. to 400° C., subsequently cold rolling the resulting steel sheet, heating a resulting cold rolled steel sheet at an average heating rate of 8° C./second or greater and 50° C./second or less through a temperature range of 400° C. to the $Ac_1$ transformation temperature, and holding the resulting cold rolled steel sheet within a temperature range of the $Ac_1$ transformation temperature or greater and the $Ac_1$ transformation temperature+150° C. or less for a period of 20 seconds or more and 3,600 seconds or less.

15. A method for manufacturing the high strength steel sheet according to claim 3, the method comprising:

performing a pickling process on a hot rolled steel sheet;

holding a resulting steel sheet within a temperature range of an $Ac_1$ transformation temperature or greater and the $Ac_1$ transformation temperature+150° C. or less for a period of more than 21,600 seconds and 259,200 seconds or less, subsequently cooling the resulting steel sheet at an average cooling rate of 5° C./hour or greater and 200° C./hour or less through a temperature range of 550° C. to 400° C., subsequently cold rolling the resulting steel sheet, heating a resulting cold rolled steel sheet at an average heating rate of 8° C./second or greater and 50° C./second or less through a temperature range of 400° C. to the $Ac_1$ transformation temperature, holding the resulting cold rolled steel sheet within a temperature range of the $Ac_1$ transformation temperature or greater and the $Ac_1$ transformation temperature+150° C. or less for a period of 20 seconds or more and 3,600 seconds or less, and subsequently performing a hot-dip galvanizing process or an electrogalvanizing process on the resulting cold rolled steel sheet.

16. A method for manufacturing the high strength steel sheet according to claim 4, the method comprising:

performing a pickling process on a hot rolled steel sheet;

holding a resulting steel sheet within a temperature range of an $Ac_1$ transformation temperature or greater and the $Ac_1$ transformation temperature+150° C. or less for a period of more than 21,600 seconds and 259,200 seconds or less, subsequently cooling the resulting steel sheet at an average cooling rate of 5° C./hour or greater and 200° C./hour or less through a temperature range of 550° C. to 400° C., subsequently cold rolling the resulting steel sheet, heating a resulting cold rolled steel sheet at an average heating rate of 8° C./second or greater and 50° C./second or less through a temperature range of 400° C. to the $Ac_1$ transformation temperature, holding the resulting cold rolled steel sheet within a temperature range of the $Ac_1$ transformation temperature or greater and the $Ac_1$ transformation temperature+150° C. or less for a period of 20 seconds or more and 3,600 seconds or less, and subsequently performing a hot-dip galvanizing process or an electrogalvanizing process on the resulting cold rolled steel sheet.

* * * * *